US007861366B2

(12) United States Patent
Hahm et al.

(10) Patent No.: US 7,861,366 B2
(45) Date of Patent: Jan. 4, 2011

(54) ROBOT CLEANER SYSTEM HAVING ROBOT CLEANER AND DOCKING STATION

(75) Inventors: Jung Yoon Hahm, Seoul (KR); Kurgi Eduard, Suwon-si (KR); Hoon Wee, Yongin-si (KR); Jin Ha Jeong, Yongin-si (KR); Jae Man Joo, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 393 days.

(21) Appl. No.: 11/653,251

(22) Filed: Jan. 16, 2007

(65) Prior Publication Data

US 2007/0226949 A1 Oct. 4, 2007

(30) Foreign Application Priority Data

| | | |
|---|---|---|
| Apr. 4, 2006 | (KR) | 10-2006-0030718 |
| Apr. 5, 2006 | (KR) | 10-2006-0030923 |
| Apr. 6, 2006 | (KR) | 10-2006-0031413 |
| Apr. 10, 2006 | (KR) | 10-2006-0032347 |
| Apr. 17, 2006 | (KR) | 10-2006-0034579 |

(51) Int. Cl.
*A47L 9/28* (2006.01)

(52) U.S. Cl. ..... 15/319; 15/340.1; 15/328

(58) Field of Classification Search ..... 15/319, 15/328, 340.1, 340.2
See application file for complete search history.

(56) References Cited

U.S. PATENT DOCUMENTS

| | | | | |
|---|---|---|---|---|
| 5,787,545 | A | 8/1998 | Colens | |
| 7,412,748 | B2 * | 8/2008 | Lee et al. | 15/340.1 |
| 7,418,762 | B2 * | 9/2008 | Arai et al. | 15/319 |
| 2002/0124343 | A1 * | 9/2002 | Reed | 15/319 |
| 2004/0255425 | A1 | 12/2004 | Arai et al. | |

(Continued)

FOREIGN PATENT DOCUMENTS

| | | | |
|---|---|---|---|
| CN | 1593326 | A | 3/2005 |

(Continued)

OTHER PUBLICATIONS

Chinese Office Action for corresponding Chinese Patent Application No. 2007100072230 dated Dec. 26, 2008 (5 pgs).

(Continued)

*Primary Examiner*—Shay L Karls
(74) *Attorney, Agent, or Firm*—Staas & Halsey LLP

(57) ABSTRACT

A robot cleaner system having an improved docking structure between a robot cleaner and a docking station, which is capable of an easy docking operation of the robot cleaner and preventing loss of a suction force generated in the docking station. The robot cleaner includes a docking portion to be inserted into a dust suction hole of the docking station upon a docking operation. The docking portion may be a protrusion, which protrudes out of a robot body to be inserted into a dust suction path defined in the docking station, the protrusion communicates a dust discharge hole of the robot cleaner with the dust suction path of the docking station. The robot cleaner system includes a coupling device to keep the robot cleaner and the docking station in their docked state. The coupling device is configured to have a variety of shapes.

24 Claims, 26 Drawing Sheets

U.S. PATENT DOCUMENTS

2005/0150519 A1 7/2005 Keppler et al.
2008/0140255 A1* 6/2008 Ziegler et al. ..... 700/245

FOREIGN PATENT DOCUMENTS

EP 1243218 9/2002
JP 2003-180587 7/2003
JP 2004-283327 10/2004

OTHER PUBLICATIONS

Chines Office Action for corresponding Chinese Patent Application No. 2007100072230 dated Jun. 26, 2009, 6 pgs.
European Office Action dated sep. 20, 2010, issued in European patent Application No. 07100609.2.

* cited by examiner

FIG.20
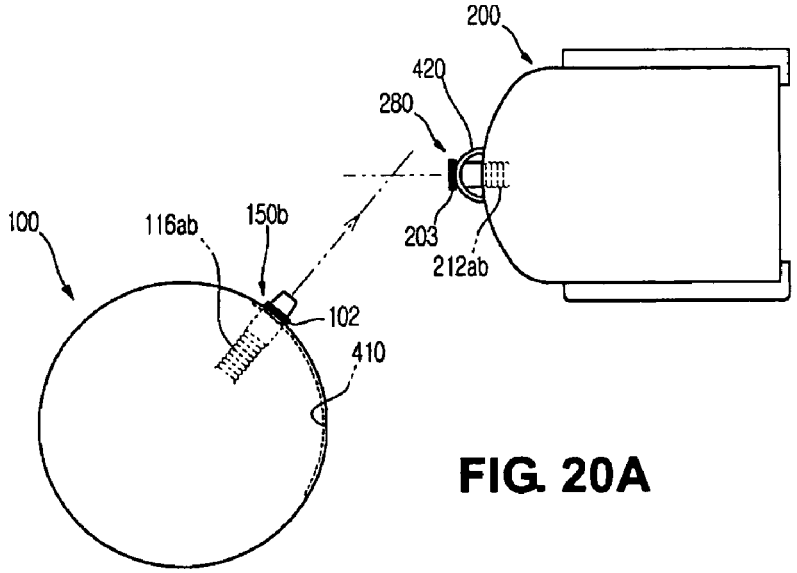
FIG. 20A
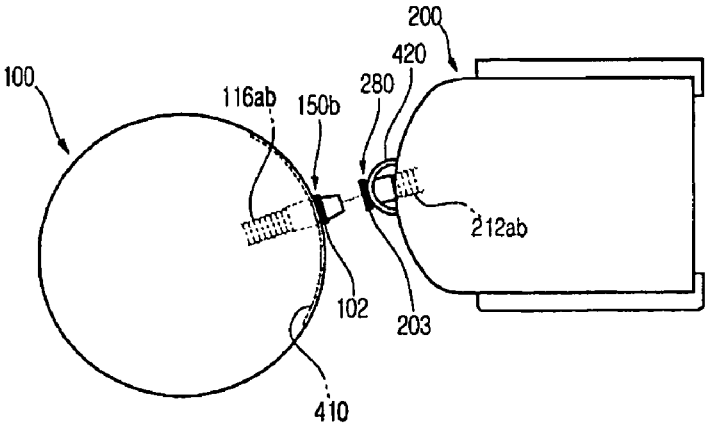
FIG. 20B
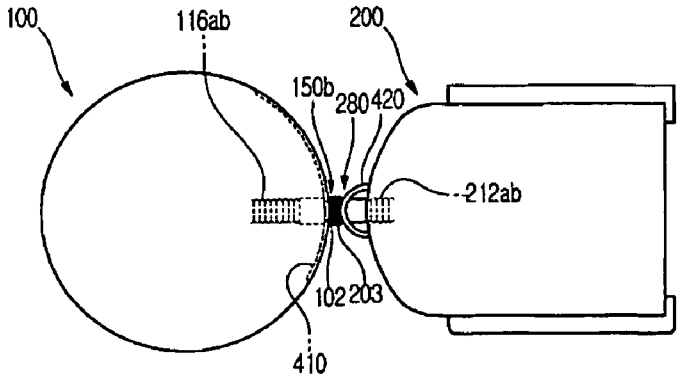
FIG. 20C

ROBOT CLEANER SYSTEM HAVING ROBOT CLEANER AND DOCKING STATION

CROSS-REFERENCE TO RELATED APPLICATIONS

This application claims the benefit of Korean Patent Application No. 10-2006-0030718 filed on Apr. 4, 2006, No. 10-2006-0030923 filed on Apr. 5, 2006, No. 10-2006-0031413 filed on Apr. 6, 2006, No. 10-2006-0032347 filed on Apr. 10, 2006 and No. 10-2006-0034579 filed on Apr. 17, 2006 in the Korean Intellectual Property Office, the disclosures of which are incorporated herein by reference.

BACKGROUND OF THE INVENTION

1. Field of the Invention

The present invention relates to a cleaner system. More particularly, to a robot cleaner system including a docking station, which is installed to suck and remove dust and debris stored in a robot cleaner.

2. Description of the Related Art

A cleaner system is a device used to remove dust in a room for cleaning the room. A conventional vacuum cleaner collects dust and loose debris by a suction force generated from a low-pressure unit included therein. A conventional robot cleaner removes dust and loose debris from the floor as it moves on the floor via a self-traveling function thereof, without requiring the user's manual operation. Hereinafter, a term "automatic cleaning" refers to a cleaning operation performed by the robot cleaner as the robot cleaner operates to remove dust and loose debris while moving by itself.

Generally, the robot cleaner is combined with a station (hereinafter, referred to as a docking station) to form a single system. The docking station is located at a specific place in a room, and serves not only to electrically charge the robot cleaner, but also to remove dust and debris stored in the robot cleaner.

One example of the above-described robot cleaner system is disclosed in U.S. Patent Publication No. 2005/0150519. The disclosed robot cleaner system includes a robot cleaner and a docking station having a suction unit to suck dust and debris. The robot cleaner includes a suction inlet at a bottom wall thereof to suck dust and loose debris, and a brush is rotatably mounted in the proximity of the suction inlet to sweep up the dust and loose debris. The docking station includes a supporting base having an inclined surface to enable the robot cleaner to ascend along. The docking station also includes a suction inlet formed at a portion of the inclined surface of the base to suck dust and loose debris. With this configuration, when the robot cleaner ascends along the inclined surface and reaches a docking position, the suction inlet formed at the inclined surface of the docking station is positioned to face the suction inlet of the robot cleaner. Thereby, as the suction unit provided in the docking station is operated, dust and debris stored in the robot cleaner can be sucked into and removed by the docking station.

However, in the disclosed conventional robot cleaner system as described above, the robot cleaner has to ascend the inclined surface of the docking station in order to reach the docking position, but the docking station is of a predetermined height. Therefore, the robot cleaner has a difficulty during a docking operation thereof due to the complicated structure for guiding the robot cleaner to an accurate docking position.

Further, since the conventional docking station performs a dust suction operation in a state where the suction inlet thereof simply faces the suction inlet of the robot cleaner, the conventional robot cleaner system has a problem in that it is difficult to stably keep the robot cleaner in a docked state due to vibrations caused by the suction unit of the docking station.

Furthermore, the conventional robot cleaner system has a poor sealing ability between both the suction inlets of the robot cleaner and docking station. Therefore, there is a problem in that a suction force generated by the suction unit is significantly reduced, thus causing the dust of the robot cleaner to be discharged into a room, rather than being suctioned into the docking station.

SUMMARY OF THE INVENTION

Accordingly, it is an aspect of the present invention to provide a robot cleaner system having an improved docking structure between a robot cleaner and a docking station, which is capable of preventing loss of a suction force generated in the docking station to suck dust and debris stored in the robot cleaner, and preventing leakage of the dust and debris being transferred into the docking station.

It is another aspect of the present invention to provide a robot cleaner system capable of stably keeping a docked state between a robot cleaner and a docking station.

It is yet another aspect of the invention to provide a robot cleaner system capable of allowing an easy docking operation of a robot cleaner.

Additional aspects and/or advantages of the invention will be set forth in part in the description which follows and, in part, will be apparent from the description, or may be learned by practice of the invention.

The foregoing and/or other aspects of the present invention are achieved by providing a robot cleaner system including a robot cleaner having a robot body and a dust discharge hole to discharge dust stored in the robot body, and a docking station having a dust suction hole to suck the dust discharged out of the robot body, a dust suction path to guide the dust, sucked through the dust suction hole, and a dust collector to collect the dust sucked through the dust suction hole, and the robot cleaner includes a first docking portion to be inserted into the dust suction hole of the docking station when the robot cleaner is docked with the docking station.

According to an aspect of the present invention, the first docking portion is a protrusion, which protrudes out of the robot body to be inserted into the dust suction hole upon a docking operation, the protrusion communicates the dust discharge hole with the dust suction path.

According to an aspect of the present invention, an outer surface of the protrusion includes a tapered surface at an outer surface thereof such that a cross sectional area of the protrusion is gradually reduced over at least a part of the protrusion along a protruding direction of the protrusion.

According to an aspect of the present invention, the dust suction path includes a guide path having a shape corresponding to that of the outer surface of the protrusion.

According to an aspect of the present invention, the protrusion is of a truncated circular cone shape.

The robot cleaner includes an opening/closing device to close the dust discharge hole while the robot cleaner performs an automatic cleaning operation and to open the dust discharge hole while the robot cleaner is docked with the docking station.

The opening/closing device includes a plurality of opening/closing units installed in a circumferential direction of the dust discharge hole, and each opening/closing unit includes an opening/closing member adapted to pivotally rotate about a pivoting shaft within the protrusion, so as to open and close the dust discharge hole, a lever extended out of the protrusion from one end of the opening/closing member coupled to the pivoting shaft, and an elastic member to elastically bias the opening/closing member in a direction of closing the dust discharge hole.

According to an aspect of the present invention, the opening/closing member is made of an elastically deformable material.

According to an aspect of the present invention, the elastic member is a coil-shaped torsion spring having a center portion to be fitted around the pivoting shaft, a first end supported by the robot body, and a second end supported by a lower surface of the lever.

The robot cleaner system further includes a coupling device provided to strongly keep the robot cleaner and the docking station in their docked state.

The coupling device includes an electromagnet installed in one of the robot cleaner and the docking station, and a magnetically attractable member installed in the other one of the robot cleaner and the docking station.

According to an aspect of the present invention, the electromagnet is installed to surround the dust suction hole, and the magnetically attractable member is installed to surround the dust discharge hole so as to correspond to the electromagnet.

The coupling device includes a coupling lever rotatably installed to the docking station, the coupling lever having a first end to be coupled with the robot cleaner when the robot cleaner is docked with the docking station.

According to an aspect of the present invention, the coupling lever includes a second end adapted to come into contact with the robot cleaner so as to cause rotation of the coupling lever, and the first end of the coupling lever is coupled with the robot cleaner as the coupling lever is rotated.

According to an aspect of the present invention, the coupling device further includes a coupling groove formed at the robot cleaner for the insertion of the coupling lever.

According to an aspect of the present invention, the docking station comprises an opening/closing device to be pushed and elastically deformed by the protrusion as the protrusion is inserted into the docking station, so as to open the dust suction hole.

According to an aspect of the present invention, the robot cleaner system further includes a sensing device to sense a completion of a docking operation of the robot cleaner, and the sensing device includes a robot sensor and a station sensor installed, respectively, to the robot cleaner and the docking station, so as to come into contact with each other when the docking operation of the robot cleaner is completed.

The docking station includes a second docking portion formed with the dust suction hole, and at least one of the first and second docking portions is installed in a movable manner.

According to an aspect of the present invention, one of the first and second docking portions includes an electromagnet, and the other one of the docking portions includes a magnetically attractable member to interact with the electromagnet.

According to an aspect of the present invention, the robot cleaner system further includes a guiding structure to guide movement of the first docking portion or second docking portion.

It is another aspect of the present invention to provide a robot cleaner system including a robot cleaner having a robot body including a dust discharge hole, and a docking station having a dust suction hole to suck dust discharged out of the robot body, a dust suction path to guide the dust, sucked through the dust suction hole, and a dust collector to collect the dust sucked through the dust suction hole, and the robot cleaner includes a protrusion, which protrudes out of the robot body to be inserted into the dust suction hole when the robot cleaner is docked with the docking station, the protrusion communicates the dust discharge hole with the dust suction path, and the protrusion is separately installed from the robot body, and one end of the protrusion is connected with the robot body by a flexible joint member having repeatedly formed pleats.

It is another aspect of the present invention to provide a robot cleaner system including a robot cleaner having a robot body formed with a dust discharge hole, and a docking station having a dust suction hole to suck dust discharged out of the robot body, a dust suction path to guide the dust, sucked through the dust suction hole, and a dust collector to collect the dust sucked through the dust suction hole, and the robot cleaner includes a protrusion, which protrudes out of the robot body to be inserted into the dust suction hole when the robot cleaner is docked with the docking station, the protrusion communicates the dust discharge hole with the dust suction path, and the dust suction path includes a guide path having a tapered surface so that the guide path is gradually narrowed over at least a part thereof in a direction along which the protrusion is introduced upon a docking operation of the robot cleaner.

According to an aspect of the present invention, the guide path is of a truncated circular cone shape having a cross sectional area that is gradually reduced away from the dust suction hole.

It is another aspect of the present invention to provide a robot cleaner system including a robot cleaner having a robot body formed with a dust discharge hole, and a docking station having a station body including a dust suction hole to correspond to a position of the dust discharge hole when the robot cleaner is docked with the docking station, and the robot cleaner includes an opening/closing device to open and close the dust discharge hole, and the opening/closing device protrudes from the dust discharge hole to be directly inserted into the dust suction hole when the robot cleaner is docked with the docking station, such that the opening/closing device communicates the dust discharge hole with the dust suction hole.

According to an aspect of the present invention, the opening/closing device includes a plurality of opening/closing units installed in a circumferential direction of the dust discharge hole, and each opening/closing unit includes an opening/closing member to pivotally rotate about a pivoting shaft so as to open and close the dust discharge hole, a lever extended from one end of the opening/closing member coupled with the pivoting shaft toward the outside of the opening/closing member, and an elastic member to elastically bias the opening/closing member in a direction of closing the dust discharge hole, and the opening/closing member is inserted into the dust suction hole upon a docking operation of the robot cleaner.

It is another aspect of the present invention to provide a robot cleaner system including a robot cleaner having a dust discharge hole and a dust discharge path to guide dust stored in the robot cleaner toward the dust discharge hole, and a docking station having a dust suction hole to suck the dust, discharged through the dust discharge hole, into the station body and a dust suction path to guide the sucked dust, and a dust collector to collect the sucked dust, and the docking station includes a docking portion to be inserted into the dust discharge hole when the robot cleaner is docked with the docking station.

According to an aspect of the present invention, the docking portion is a protrusion, which protrudes out of the station body to be inserted into the dust discharge hole upon a docking operation, the protrusion communicates the dust suction hole with the dust discharge path.

According to an aspect of the present invention, the protrusion includes a tapered surface at an outer surface thereof so that a cross sectional area of the protrusion is gradually reduced over at least a part of the protrusion along a protruding direction of the protrusion.

The dust discharge path includes a guide path having a shape corresponding to that of the outer surface of the protrusion.

According to an aspect of the present invention, the docking portion is a docking lever rotatably installed to the docking station, the docking lever having a first end to pivotally rotate so as to be inserted into the dust discharge hole upon the docking operation of the robot cleaner.

The docking lever includes a first arm to come into contact with the robot cleaner, so as to rotate the docking lever, and a second arm to be inserted into the dust discharge hole as the docking lever is rotated.

According to an aspect of the present invention, the docking lever includes a connecting hole to communicate the docking lever with the dust suction path when the first end of the docking lever is inserted into the dust discharge hole.

According to an aspect of the present invention, the robot cleaner system further includes an elastic member to elastically bias the docking lever in a direction of separating the first end of the docking lever from the dust discharge hole.

It is another aspect of the present invention to provide a robot cleaner including a robot body including a dust discharge hole to discharge dust stored in the robot cleaner toward a dust suction hole of a docking station, the robot cleaner further including a protrusion to protrude out of the robot body so as to be inserted into the dust suction hole when the robot cleaner is docked with the docking station, the protrusion communicating the dust discharge hole with the dust suction hole.

It is another aspect of the present invention to provide a robot cleaner including a dust discharge hole to discharge dust into a docking station and a dust discharge path to guide the dust in a dust collector toward the dust discharge hole, and the dust discharge path includes a guide path having a tapered surface so that the path is gradually narrowed in a direction along which a protrusion of the docking station inserted in the dust discharge hole is introduced into the dust discharge path.

It is another aspect of the present invention to provide a docking station including a station body including a dust suction hole to suck dust discharged from a dust discharge hole of a robot cleaner, the docking station further includes a protrusion configured to protrude out of the station body so as to be inserted into the dust discharge hole when the robot cleaner is docked with the docking station, the protrusion communicating the dust suction hole with the dust discharge hole.

It is another aspect of the present invention to provide a docking station including a dust suction hole to suck dust stored in a robot cleaner and a dust suction path to guide the dust, sucked through the dust suction hole, to a dust collector, and the dust suction path includes a guide path having a tapered surface so that the path is gradually narrowed in a direction along which a protrusion of the robot cleaner inserted in the dust suction hole is introduced into the dust suction path.

BRIEF DESCRIPTION OF THE DRAWINGS

These and/or other aspects and advantages of the invention will become apparent and more readily appreciated from the following description of the embodiments, taken in conjunction with the accompanying drawings of which:

FIGS. 20A to 20C are plan views illustrating operational parts of the robot cleaner system of FIG. 17;

DETAILED DESCRIPTION OF THE PREFERRED EMBODIMENTS

Figure 1:
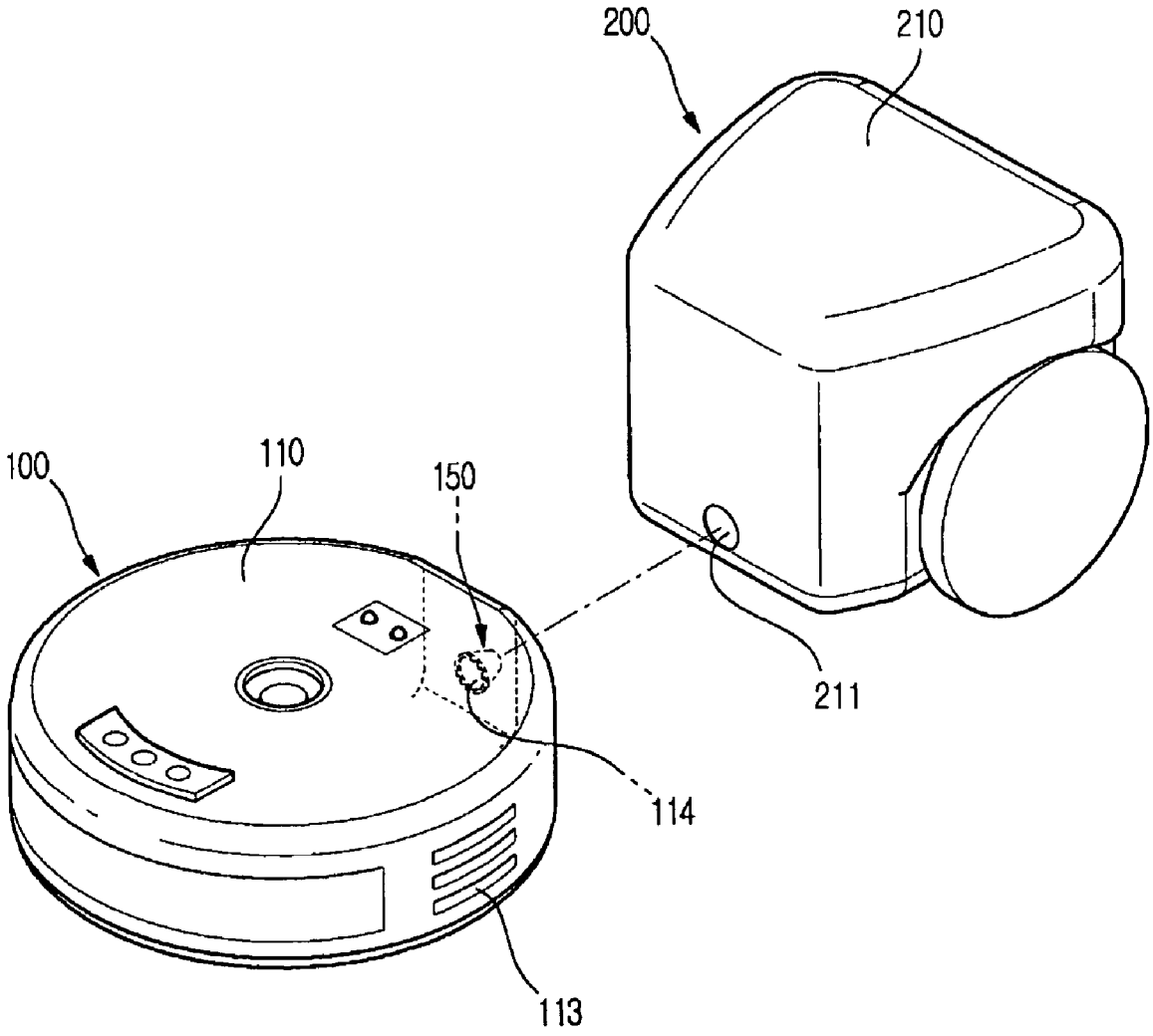
FIG. 1 is a perspective view illustrating an outer appearance of a robot cleaner system according to a first embodiment of the present invention.

Reference will now be made in detail to embodiments of the present invention, examples of which are illustrated in the accompanying drawings, wherein like reference numerals refer to like elements throughout. The embodiments are described below to explain the present invention by referring to the figures.

Figure 2:
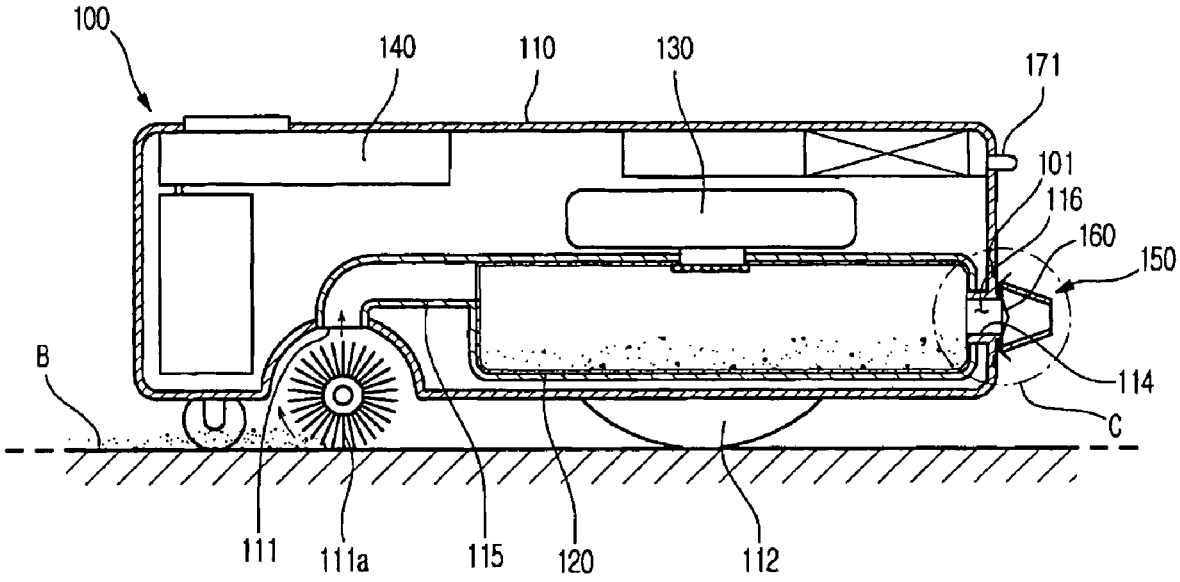
FIGS. 2 and 3 are side sectional views, respectively illustrating the configuration of a robot cleaner and a docking station of FIG. 1.
Figure 3:
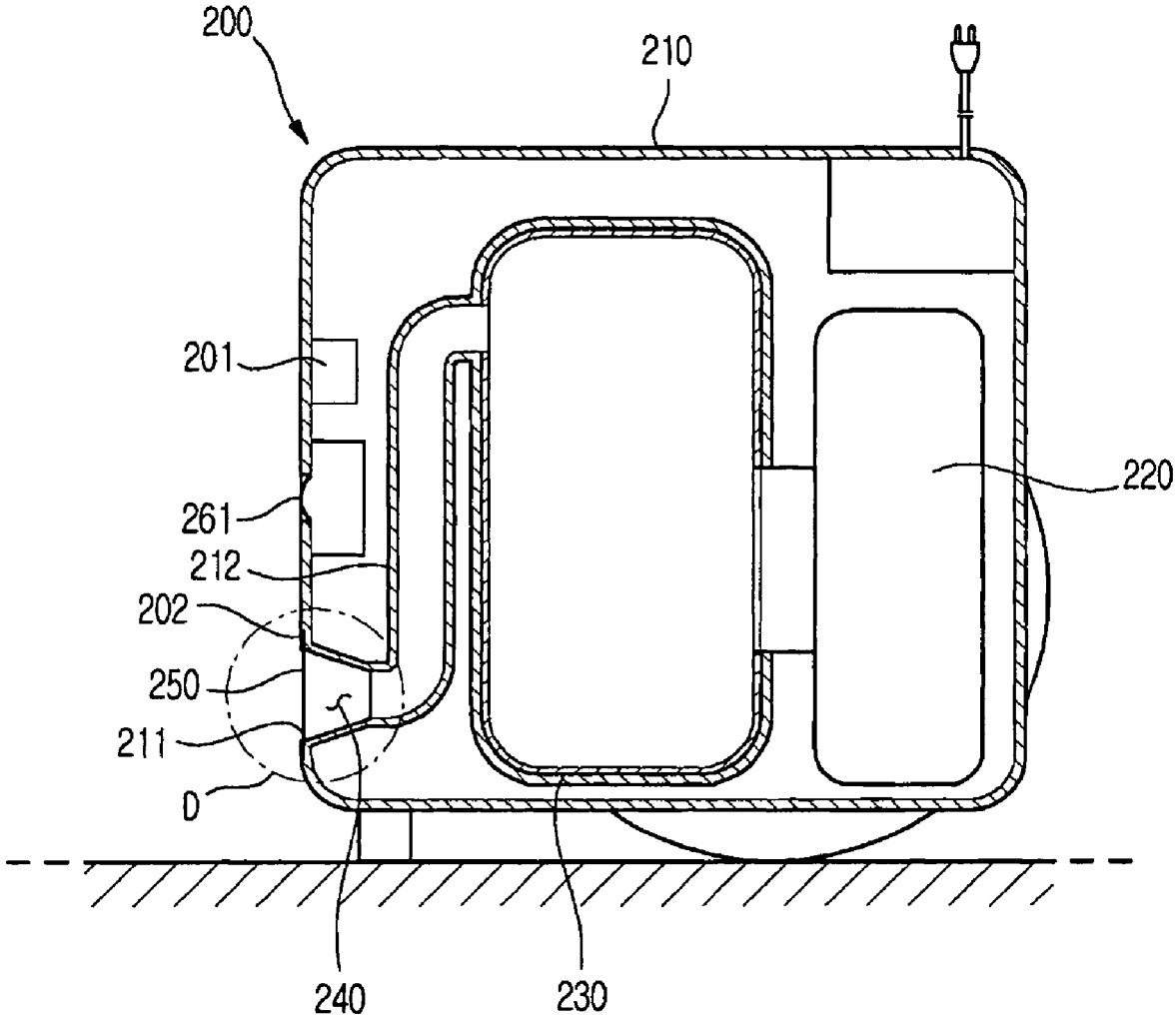
Figure 4:
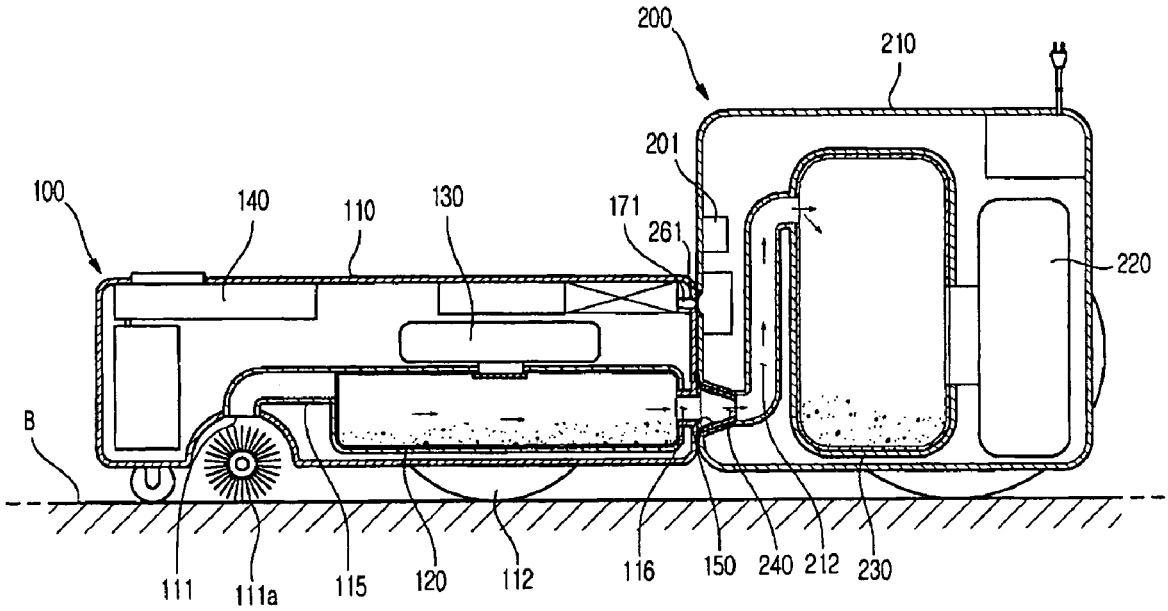
FIG. 4 is a side sectional view of the robot cleaner system illustrating a docked state between the robot cleaner and the docking station.

FIG. 1 is a perspective view illustrating the outer appearance of a robot cleaner system according to a first embodiment of the present invention. FIGS. 2 and 3 are side sectional views, respectively, illustrating the configuration of a robot cleaner and a docking station of FIG. 1. FIG. 4 is a side sectional view of the robot cleaner system, illustrating a docked state between the robot cleaner and the docking station.

As shown in FIGS. 1-4, the robot cleaner system according to the first embodiment of the present invention comprises a robot cleaner 100 and a docking station 200. The robot cleaner 100 includes a robot body 110 formed with a dust inlet hole 111, and a first dust collector 120 mounted in the robot body 110 to store sucked dust and debris. The docking station 200 removes the dust and debris stored in the first dust collector 120 when being docked with the robot cleaner 100. In operation, the robot cleaner 100 performs an automatic cleaning operation while moving throughout an area to be cleaned by itself. If the amount of dust and debris collected in the first dust collector 120 reaches a predetermined level, the robot cleaner 100 returns to the docking station 200.

As shown in FIG. 2, the robot cleaner 100 further comprises a first blower 130 mounted in the robot body 110 to generate a suction force required to suck dust and loose debris. The first blower 130 comprises a suction motor (not shown) and a blowing fan (not shown). In addition, a sensor (not shown) for detecting the amount of dust and debris collected in the first dust collector 120 and a controller 140 to control overall operations of the robot cleaner 100 are provided in the robot body 110.

The robot body 110 comprises a pair of drive wheels 112 at a bottom wall thereof, to enable movement of the robot cleaner 100. The pair of drive wheels 112 are selectively operated by a drive motor (not shown) that acts to rotate the wheels 112, respectively. With rotation of the drive wheels 112, the robot cleaner 100 is able to move in a desired direction.

The robot cleaner 100 comprises the dust inlet hole 111 formed at the bottom wall of the robot body 110 to suck dust and loose debris from the floor in an area to be cleaned, an air outlet hole 113 (See FIG. 1) to discharge an air stream, which is generated by the first blower 130, to the outside of the robot body 110, and a dust discharge hole 114 to discharge dust and debris stored in the first dust collector 120 into the docking station 200 when the robot cleaner 100 is docked with the docking station 200.

A brush 111*a* is rotatably mounted in the proximity of the inlet hole 111 of the robot body 110 to sweep up dust and loose debris from the floor B. Also, an inlet pipe 115 is provided between the inlet hole 111 and the first dust collector 120 to connect them to each other, and a dust discharge path 116 is defined between the first dust collector 120 and the dust discharge hole 114.

Referring to FIG. 3, the docking station 200 comprises a station body 210, a second blower 220 mounted in the station body 210 to generate a suction force required to suck dust and debris, and a second dust collector 230 mounted in the station body 210 to store the sucked dust and debris. Although not shown in the drawings, the second blower 220 comprises a suction motor, and a blowing fan to be rotated by the suction motor. Meanwhile, the docking station 200 comprises a controller 201 to control overall operations of the docking station 200.

The docking station 200 comprises a dust suction hole 211, which is formed at a position corresponding to the dust discharge hole 114 of the robot cleaner 100, to suck dust and debris from the robot cleaner 100. A dust suction path 212 is defined between the dust suction hole 211 and the second dust collector 230.

When the second blower 220 is operated in a state wherein the robot cleaner 100 is docked with the docking station 200 as shown in FIG. 4, a suction force is applied to the first dust collector 120 of the robot cleaner 100, thus causing the dust and debris stored in the first dust collector 120 to be sucked into the second dust collector 230 through the dust discharge path 116 and the dust suction path 212.

More particularly, as shown in FIGS. 2 to 4, the robot cleaner 100 comprises a first docking portion 150 inserted into the dust suction hole 211 when the robot cleaner 100 is docked with the docking station 200. By initiating the transfer of dust and debris stored in the robot cleaner 100 after the first docking portion 150 of the robot cleaner 100 is inserted into the dust suction hole 211 of the docking station 200, the present invention has the effects of preventing loss of the suction force generated in the docking station 200 and preventing leakage of the dust and debris into a room.

Figure 5:
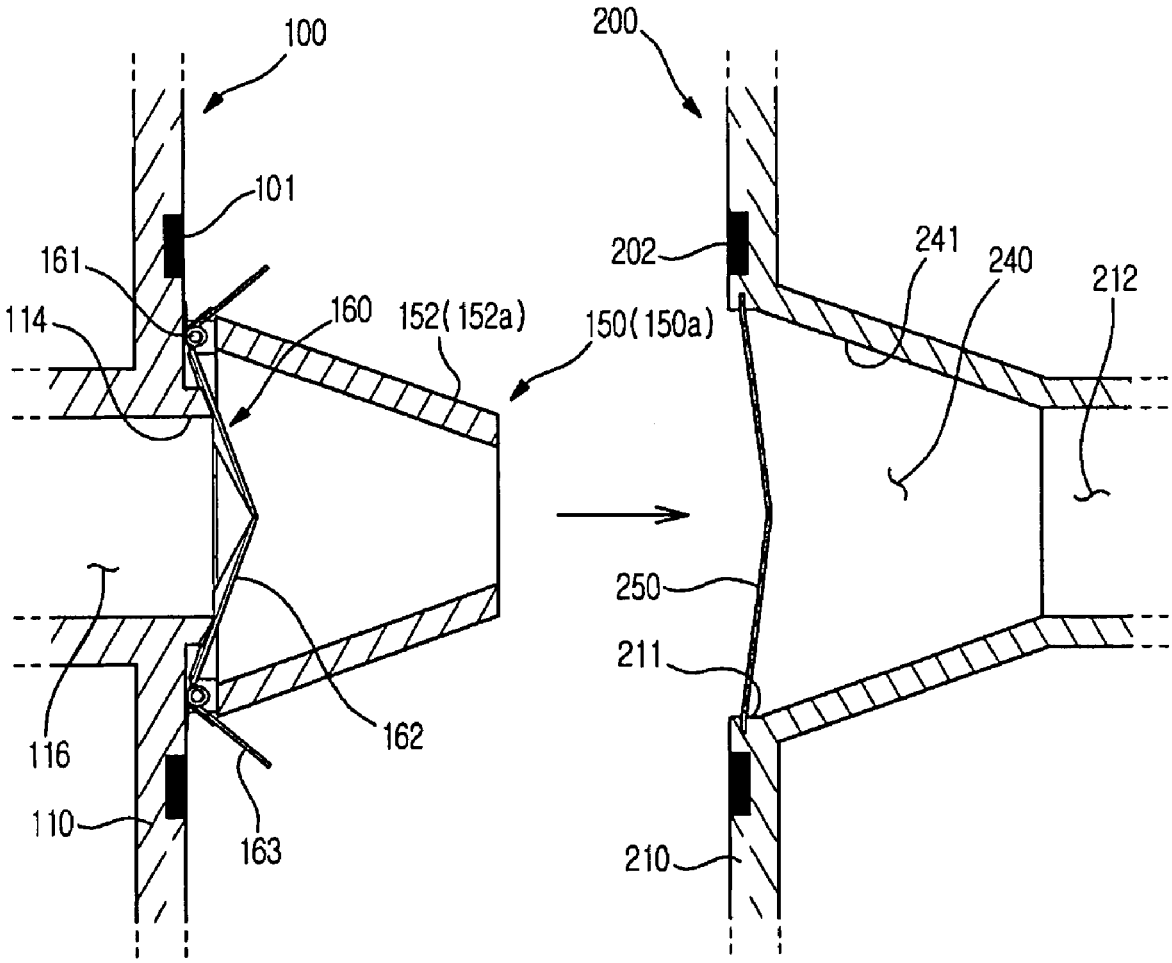
FIGS. 5 and 6 are an enlarged sectional view and a partial cut-away perspective view, respectively, showing the circle 'C' of FIG. 2 and the circle 'D' of FIG. 3.
Figure 6:
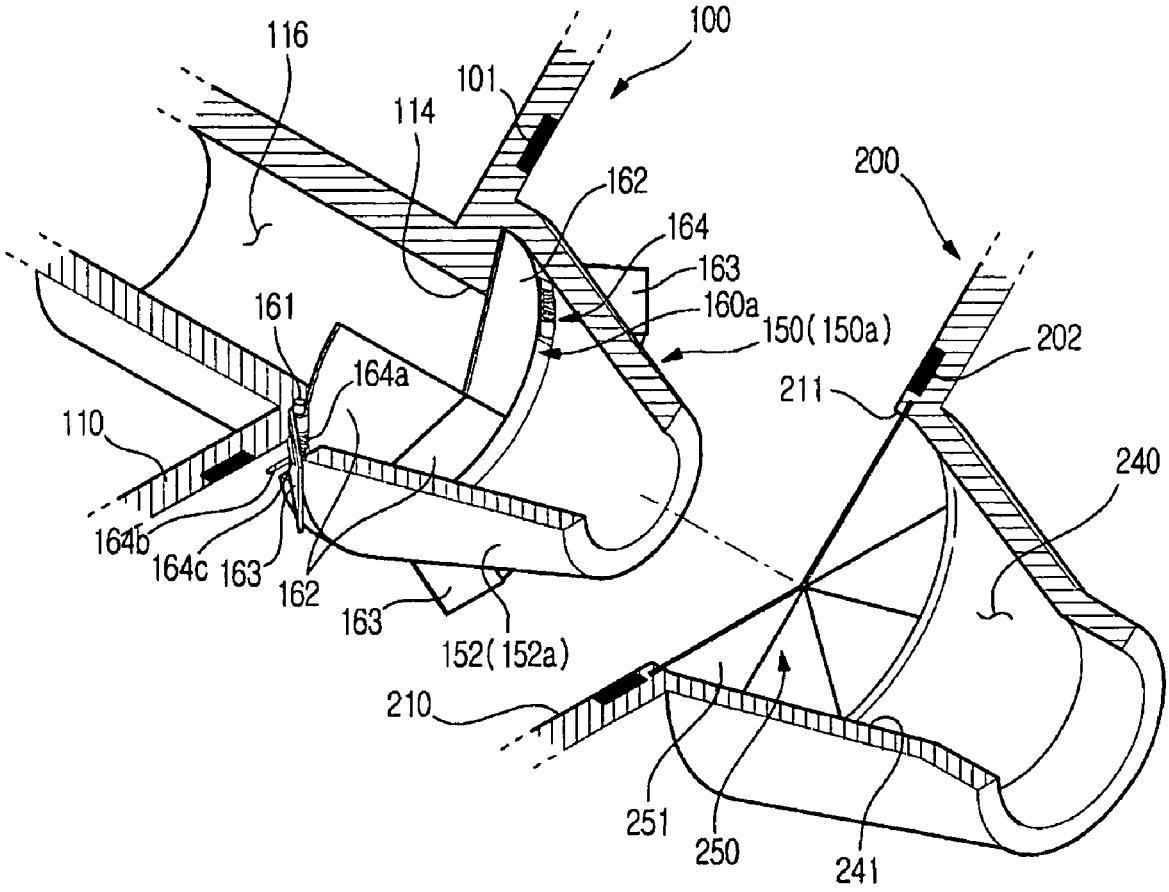
Figure 7:
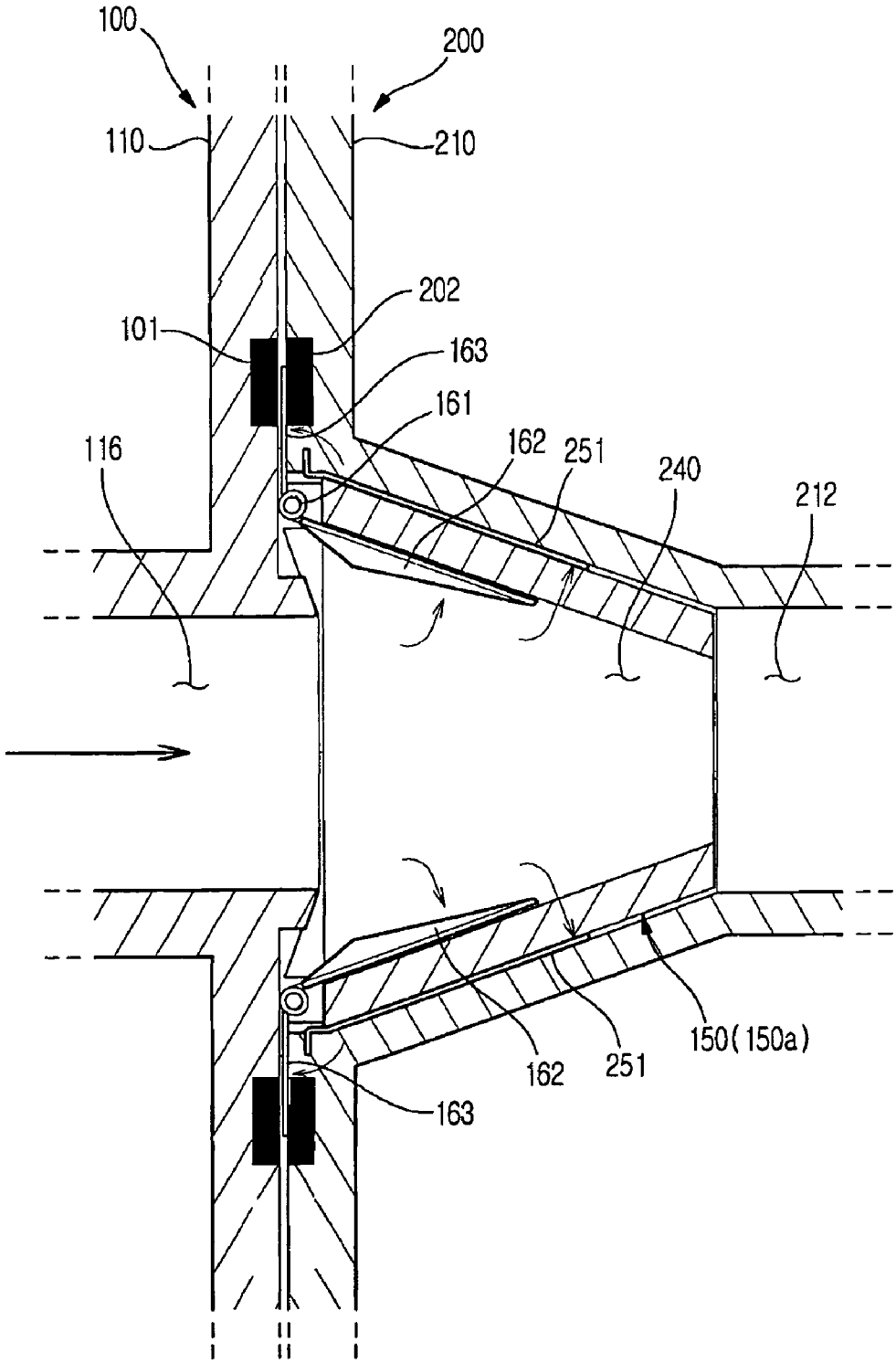
FIG. 7 is a sectional view illustrating a docked state of the robot cleaner of FIG. 5.

FIGS. 5 and 6 are an enlarged sectional view and a partial cut-away perspective view, respectively, showing the circle 'C' of FIG. 2 and the circle 'D' of FIG. 3. FIG. 7 is a sectional view showing a docked state of the robot cleaner of FIG. 5.

As shown in FIGS. 5 to 7, according to an embodiment of the present invention, the first docking portion 150 of the robot cleaner 100 is a protrusion 150*a*, which protrudes out of the robot body 110 to be inserted into the dust suction hole 211 when the robot cleaner 100 is docked with the docking station 200. The protrusion 150*a* communicates the dust discharge hole 114 with the dust suction path 212.

According to an embodiment of the present invention, an outer surface 152 of the protrusion 150*a* comprises a tapered surface 152*a* so that a cross sectional area of the protrusion 150*a* is gradually reduced over at least a part of the protrusion along a protruding direction of the protrusion 150*a*. Similarly, the dust suction path 212 of the docking station 200 comprises a guide path 240 having a shape corresponding to that of the outer surface 152 of the protrusion 150*a*. Specifically, the guide path 240 comprises a tapered surface 241 so that the path 240 is gradually narrowed in an introducing direction of the protrusion 150*a* of the robot cleaner 100 to be docked with the docking station 200. In this embodiment of the present invention, the guide path 240 and the protrusion 150*a* each have a truncated circular cone shape. With the use of the protrusion 150*a* and the guide path 240 having the tapered surfaces 152*a* and 241, even when the protrusion 150*a* begins to be introduced into the dust suction hole 211 at a position slightly deviated from an accurate docking position, the tapered surfaces 152*a* and 241 of the protrusion 150*a* and guide path 240 can guide a docking operation as the protrusion 150*a* is continuously introduced into the guide path 240, thereby guaranteeing a smooth docking operation between the robot cleaner 100 and the docking station 200. Furthermore, once the robot cleaner 100 is completely docked with the docking station 200, the guide path 240 and the protrusion

150*a* have an increased contact area. Therefore, no gap is defined between the guide path 240 and the protrusion 150*a* and leakage of the suction force generated by the second blower 220 during the suction of dust and debris can be more completely prevented.

The robot cleaner 100 comprises a first opening/closing device 160. The first opening/closing device 160 operates to close the dust discharge hole 114 while the robot cleaner 100 performs an automatic cleaning operation and to open the dust discharge hole 114 while the robot cleaner 100 is docked with the docking station 200. Specifically, the first opening/closing device 160 closes the dust discharge hole 114 during the automatic cleaning operation of the robot cleaner 100, to prevent unwanted introduction of air through the dust discharge hole 114. This has the effect of preventing deterioration in the suction force of the first blower 130 to be applied to the inlet hole 111. Conversely, while the robot cleaner 100 is docked with the docking station 200 to remove the dust and debris stored in the first dust collector 120, the first opening/closing device 160 opens the dust discharge hole 114, to allow the dust and debris in the first dust collector 120 to be transferred into the docking station 200.

According to an embodiment of the present invention, the first opening/closing device 160 comprises a plurality of opening/closing units 160*a*, which are arranged in a circumferential direction of the dust discharge hole 114 to open and close the dust discharge hole 114. Each of the opening/closing units 160*a* includes an opening/closing member 162 to pivotally rotate about a pivoting shaft 161 within the protrusion 150*a* so as to open and close the dust discharge hole 114, a lever 163 that extends out of the protrusion 150*a* from one end of the opening/closing member 162 coupled to the pivoting shaft 161, and an elastic member 164 that is used to elastically bias the opening/closing member 162 in a direction of closing the dust discharge hole 114.

Each opening/closing member 162 is hinged to a lower end of the protrusion 150*a* via the pivoting shaft 161, and each lever 163 extends out of the protrusion 150*a* to have a predetermined angle relative to an extending direction of the associated opening/closing member 162. With the above described configuration of the first opening/closing device 160, the lever 163 of the first opening/closing device 160 is pushed and pivotally rotated by the station body 210 at a time point when the robot cleaner 100 is completely docked with the docking station 200, thereby allowing the opening/closing member 162 to be also pivotally rotated to open the dust discharge hole 114 of the robot cleaner 100.

According to an embodiment of the present invention, the opening/closing member 162 is made of an elastically deformable material, such as a thin metal, plastic or rubber material, or the like, to allow the opening/closing member 162 to come into close contact with an inner surface of the protrusion 150*a* having a truncated circular cone shape when it opens the dust discharge hole 114. This has the effect of preventing a path defined in the protrusion 150*a* from being narrowed by the opening/closing member 162.

Meanwhile, each elastic member 164 stably keeps the associated opening/closing member 162 in a state of closing the dust discharge hole 114 while the robot cleaner 100 performs the automatic cleaning operation. In FIG. 6, the elastic member 164 in the form of a torsion spring coiled on the pivoting shaft 161. The elastic member 164 in the form of a torsion spring includes a center portion 164*a* to be fitted around the pivoting shaft 161 and both ends 164*b* and 164*c* to be supported by an outer surface of the robot body 110 and a lower surface of the lever 163, respectively.

Although FIG. 6 illustrates four opening/closing units 160*a*, the number of the opening/closing units 160*a* is not limited hereto and may vary, as necessary. Also, the first opening/closing device may be embodied in a different novel manner from the above description. For example, according to an embodiment of the present invention, the first opening/closing device comprises a sliding door installed in the dust discharge hole of the robot cleaner and a switch installed to the outer surface of the robot body at a position where it comes into contact with the docking station. In this case, when the switch is pushed by the docking station, in the course of docking the robot cleaner with the docking station, the sliding door is operated to open the dust discharge hole.

Similar to the robot cleaner 100 having the first opening/closing device 160, according to an embodiment of the present invention, the docking station 200 comprises a second opening/closing device 250 to open and close the dust suction hole 211. According to an embodiment of the present invention, the dust suction hole 211 of the docking station 200 is configured to remain opened without a separate opening/closing device. However, with the provision of the second opening/closing device 250 as shown in FIG. 6, the present invention has the effect of preventing backflow and leakage of the sucked dust and debris in the dust suction path 212 or second dust collector 230 of the docking station 200.

The second opening/closing device 250 comprises a plurality of opening/closing members 251 having an elastic restoration force. Each of the opening/closing members 251 comprises one end secured to the station body 210 and the other free end extending toward the center of the dust suction hole 211. With this configuration, when the protrusion 150*a* of the robot cleaner 100 is introduced into the guide path 240, the opening/closing member 251 is pushed and elastically deformed by the protrusion 150*a*, so as to open the dust suction hole 211. Then, when the robot cleaner 100 is undocked from the docking station 200, the opening/closing member 251 is returned to its original position, to thereby close the dust suction hole 211.

Referring again to FIGS. 2-4, the robot cleaner system according to the present invention further comprises a sensing device to sense whether or not the robot cleaner 100 completes its docking operation. The sensing device comprises a robot sensor 171 and a station sensor 261, which are mounted to the robot cleaner 100 and the docking station 200, respectively, and comes into contact with each other at a time point when the robot cleaner 100 is completely docked with the docking station 200. When the robot sensor 171 comes into contact with the station sensor 261, the controller 201 of the docking station 200 determines that the robot cleaner 100 completes the docking operation.

The robot cleaner system according to an embodiment of the present invention further comprises a coupling device to stably keep the robot cleaner 100 and the docking station 200 in a docked state. The coupling device comprises an electromagnet 202 installed in the docking station 200 and a magnetically attractable member 101 installed in the robot cleaner 100. When the robot cleaner 100 is completely docked with the docking station 200, an electric current is applied to the electromagnet 202 to thereby generate a magnetic force. Thereby, the robot cleaner 100 and the docking station 200 are attracted to each other, to allow the robot cleaner 100 and the docking station 200 to stably keep their docked state.

According to an aspect of the present invention, the electromagnet 202 of the docking station 200 is mounted to surround an outer periphery of the dust suction hole 211, and the magnetically attractable member 101 of the robot cleaner 100 is mounted to surround an outer periphery of the dust discharge hole 114 to correspond to the electromagnet 202.

In the above described embodiment of the present invention, although the electromagnet is described to be mounted in the docking station, the location of the electromagnet is not limited hereto and may vary as necessary. For example, the electromagnet may be installed in the robot cleaner and the magnetically attractable member may be installed in the docking station.

Figure 8:
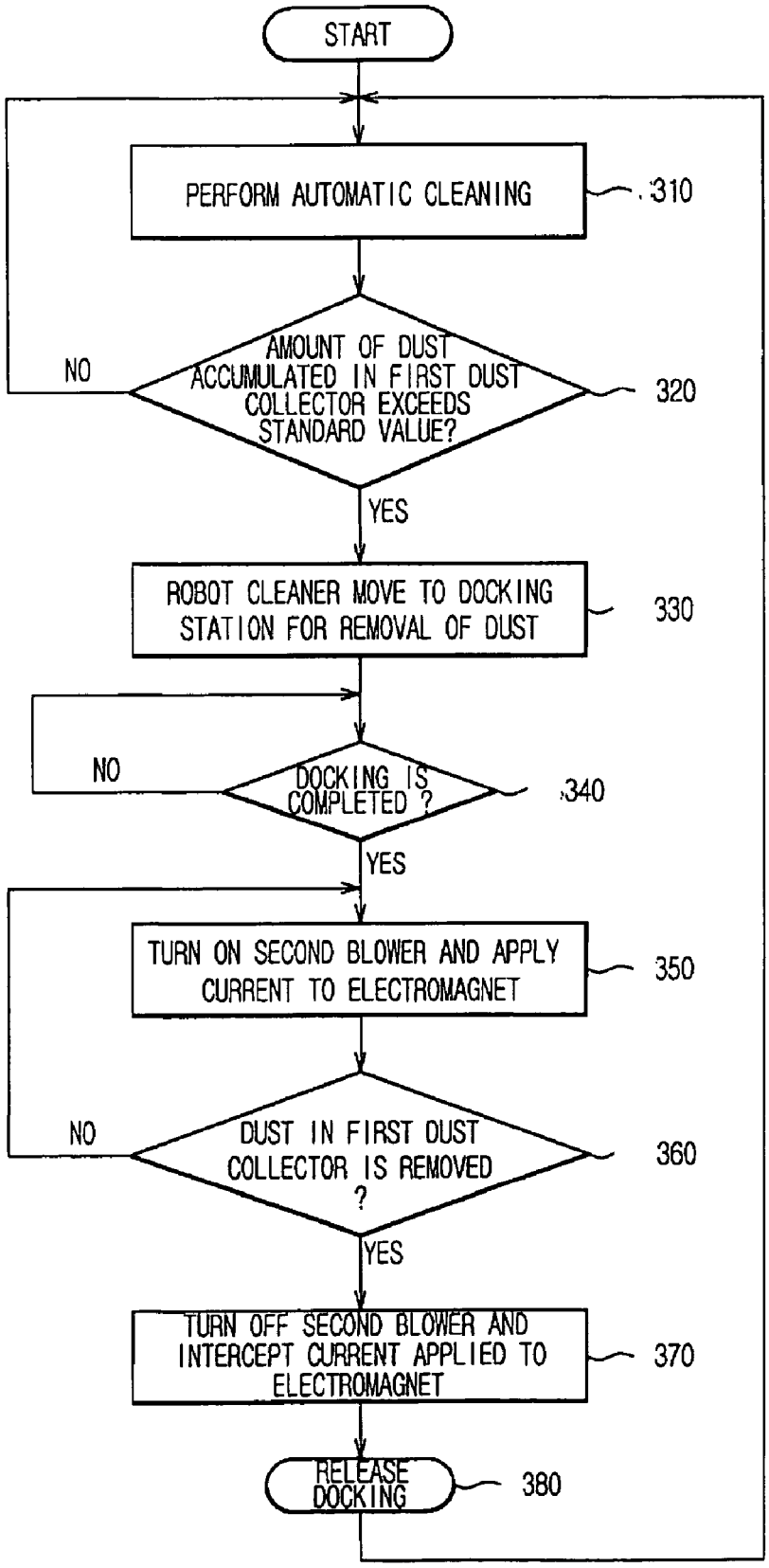
FIG. 8 is a flowchart illustrating an operation of the robot cleaner system according to an embodiment of the present invention.

Now, the operation of the robot cleaner system according to an embodiment of the present invention will now be explained with reference to FIGS. 2-4 and FIG. 8. FIG. 8 is a flowchart illustrating the operation of the robot cleaner system according to an embodiment of the present invention. Hereinafter, although the operation of the robot cleaner system according to the first embodiment of the present invention will be described, it is noted that these operations may be similarly applicable to other embodiments that will be explained hereinafter.

In operation 310, if an automatic cleaning operation command is inputted, the robot cleaner 100 operates to remove dust and loose debris in an area to be cleaned while moving by itself. In this case, each opening/closing member 162 of the first opening/closing device 160 provided at the robot cleaner 100 is in a state of closing the dust discharge hole 114 by use of the elasticity of the elastic member 164. Accordingly, the suction force of the first blower 130 is able to be wholly applied to the inlet hole 111, so as to effectively suck dust and loose debris from the floor B. The sucked dust and debris are collected in the first dust collector 120 after passing through the inlet pipe 115 under operation of the first blower 130.

During the above described automatic cleaning operation, with the use of the a sensor (not shown) that is provided to sense the amount of dust and debris within the robot cleaner 100, the amount of dust and debris accumulated in the first dust collector 120 is sensed and the sensed data is transmitted to the controller 140. On the basis of the data, in operation 320, the controller 140 determines whether the amount of dust and debris accumulated in the first dust collector 120 exceeds a standard value.

When it is determined that the amount of dust and debris accumulated in the first dust collector 120 exceeds a standard value in operation 320, the process moves to operation 330, where the robot cleaner 100 stops the automatic cleaning operation, and moves toward the docking station 200 for the removal of the dust and debris therein. The configuration and operation required for the return of the robot cleaner 100 to the docking station 200 are well known in the art and thus, detailed description thereof is omitted.

Once a docking operation begins, the protrusion 150*a* is introduced into the guide path 240 through the dust suction hole 211 of the docking station 200. In this case, even when the protrusion 150 begins to be introduced into the dust suction hole 211 at a position deviated from an accurate docking position, the tapered surfaces 152*a* and 241 of the protrusion 150*a* and guide path 240 having a truncated circular cone shape, guide the continued introducing operation of the protrusion 150*a*, thereby enabling a smooth and accurate docking operation. Meanwhile, when the protrusion 150*a* begins to be introduced into the dust suction hole 211, the second opening/closing device 250 is pushed by the protrusion 150*a*, thereby opening the dust suction hole 211. Also, as the introduction of the protrusion 150*a* is continued, each lever 163 of the first opening/closing device 160 is pushed by the station body 210. Thereby, each opening/closing member 162 is pivotally rotated about the associated pivoting shaft 161 to open the dust discharge hole 114. During the above-described docking operation, the process moves to operation 340, where the controller 201 of the docking station 200 determines, by use of the robot sensor 171 and the station sensor 261, whether the robot cleaner 100 completes the docking operation.

When the robot sensor 171 comes into contact with the station sensor 261, the controller 201 of the docking station 200 determines that the docking operation of the robot cleaner 100 is completed. On the basis of the determined result in operation 340, the process moves to operation 350, where the controller 201 allows an electric current to be applied to the electromagnet 202 and simultaneously, operates the second blower 220. Thereby, under the operation of the second blower 220, the dust and debris stored in the first dust collector 120 of the robot cleaner 100 are removed from the first dust collector 120 and sucked into the second dust collector 230. In this case, the docking station 200 and the robot cleaner 100 are able to stably keep their docked state by the magnetic attraction between the electromagnet 202 and the magnetically attractable member 101.

In the course of removing the dust and debris from the first dust collector 120, a dust sensor (not shown) of the robot cleaner 100 senses the amount of dust and debris accumulated in the first dust collector 120 and transmits the sensed result to the controller 140. On the basis of the transmitted result, the controller 140 determines whether the dust and debris in the first dust collector 120 are sufficiently removed in operation 360. If the sufficient removal of dust and debris is determined in operation 360, the process moves to operation 370, where the controller 140 stops the operation of the second blower 220, and intercepts the supply of the electric current to the electromagnet 202. In this case, instead of controlling the second blower 220 and electromagnet 202 using the controller 140 of the robot cleaner 100, the second blower 220 and electromagnet 202 is controlled by the controller 201 of the docking station 200 as the controller 201 receives information from the controller 140. Alternatively, the removal of dust and debris from the first dust collector 120 may be determined by counting an operating time of the second blower 220, rather than using the dust sensor. If the operating time of the second blower 220 exceeds a predetermined time, it can be determined that dust and debris within the robot cleaner 100 are sufficiently removed.

After the removal of dust and debris is completed in operation 360, the process moves to operation 380, where the robot cleaner 100 is undocked from the docking station 200, to again perform the automatic cleaning operation.

Although the above described embodiment shown in FIGS. 1-7 exemplifies the case where both the protrusion and the guide path have tapered surfaces, the present invention is not limited hereto, and any one of the protrusion and the guide path may have a tapered surface. For example, the protrusion may have a cylindrical shape, and the guide path may have a truncated circular cone shape.

Figure 9A:
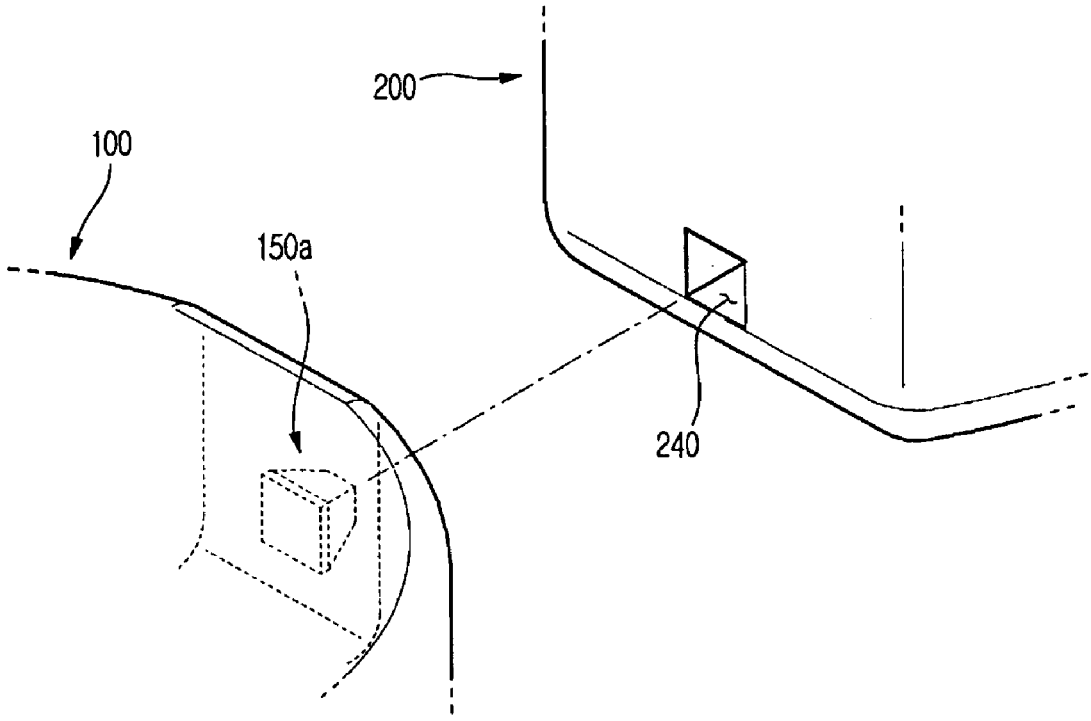
FIGS. 9A and 9B are perspective views schematically illustrating the outer appearance of a robot cleaner system according to a second embodiment of the present invention.
Figure 9B:
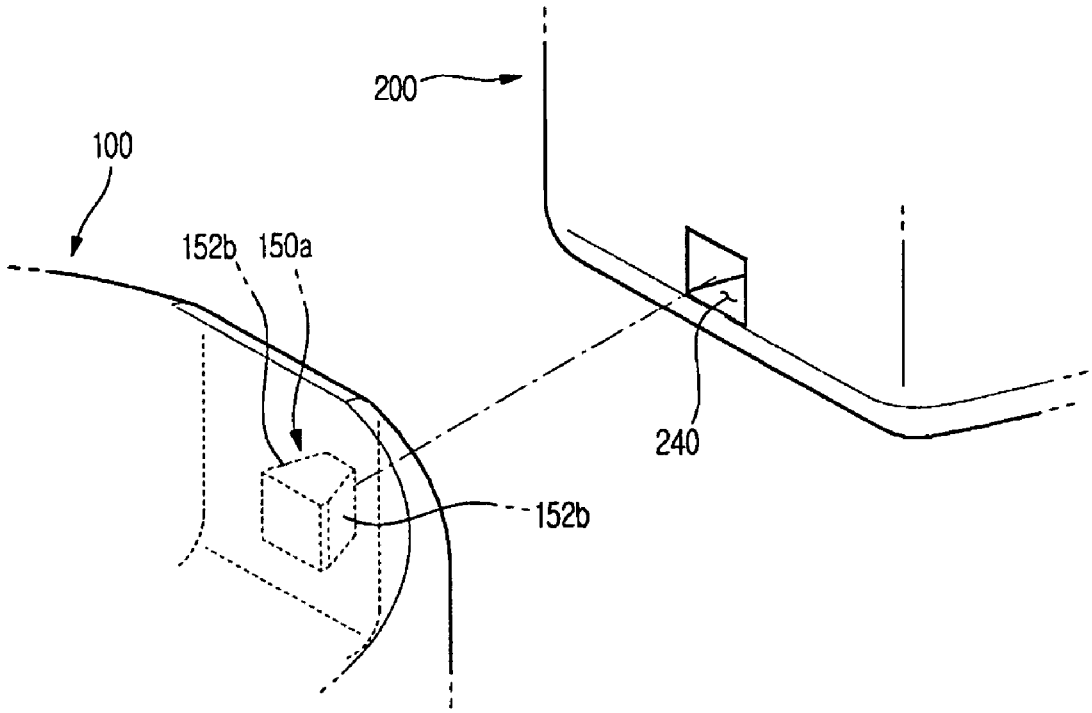

FIGS. 9A and 9B are perspective views schematically illustrating the outer appearance of a robot cleaner system according to a second embodiment of the present invention. The present embodiment has a difference in the shape of the protrusion and guide path as compared to the above-described first embodiment. More particularly, FIG. 9A illustrates an example that the protrusion 150*a* and the guide path 240 have a truncated angled cone shape, and FIG. 9B illustrates an example that opposite side portions of the outer surface of the protrusion 150*a* have inclined surfaces 152*b*, and the guide path 240 has a shape corresponding to the shape of the protrusion 150*a*.

Figure 10:
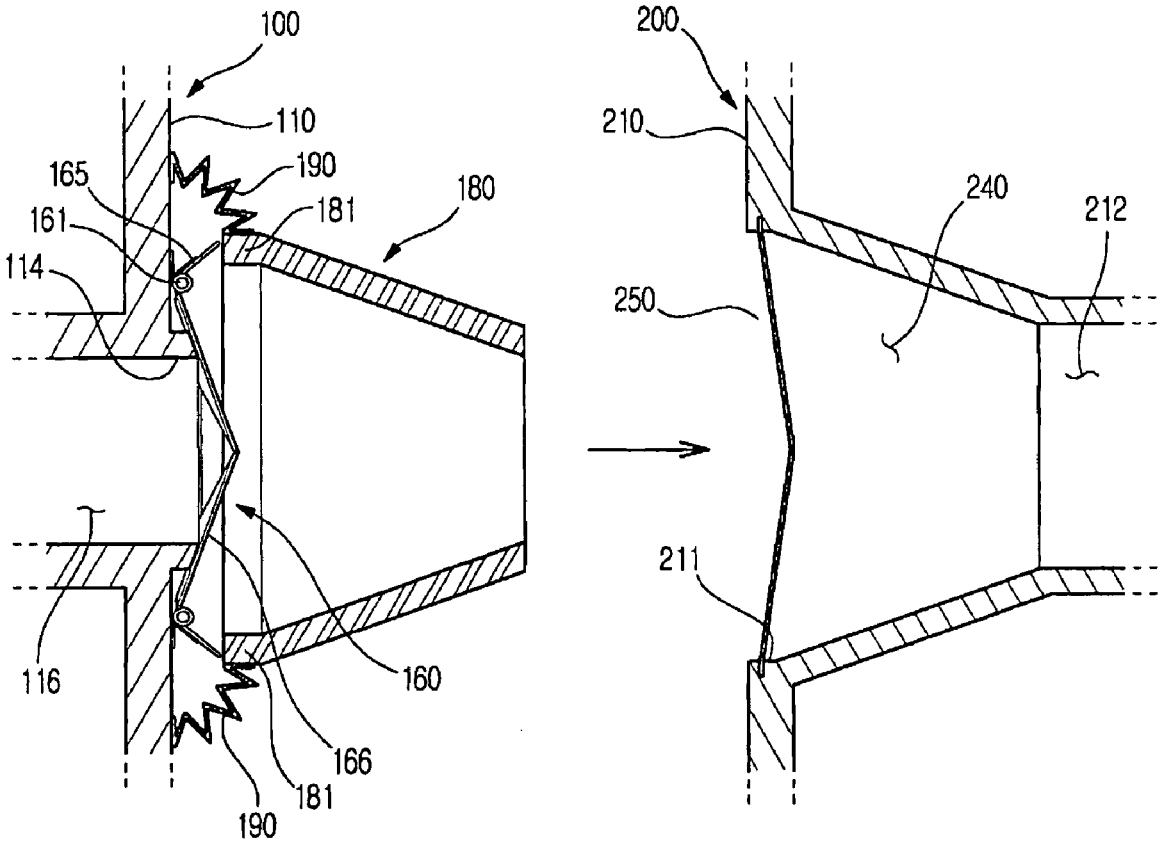
FIG. 10 is a sectional view illustrating a protrusion and a guide path provided in a robot cleaner system according to a third embodiment of the present invention.
Figure 11:
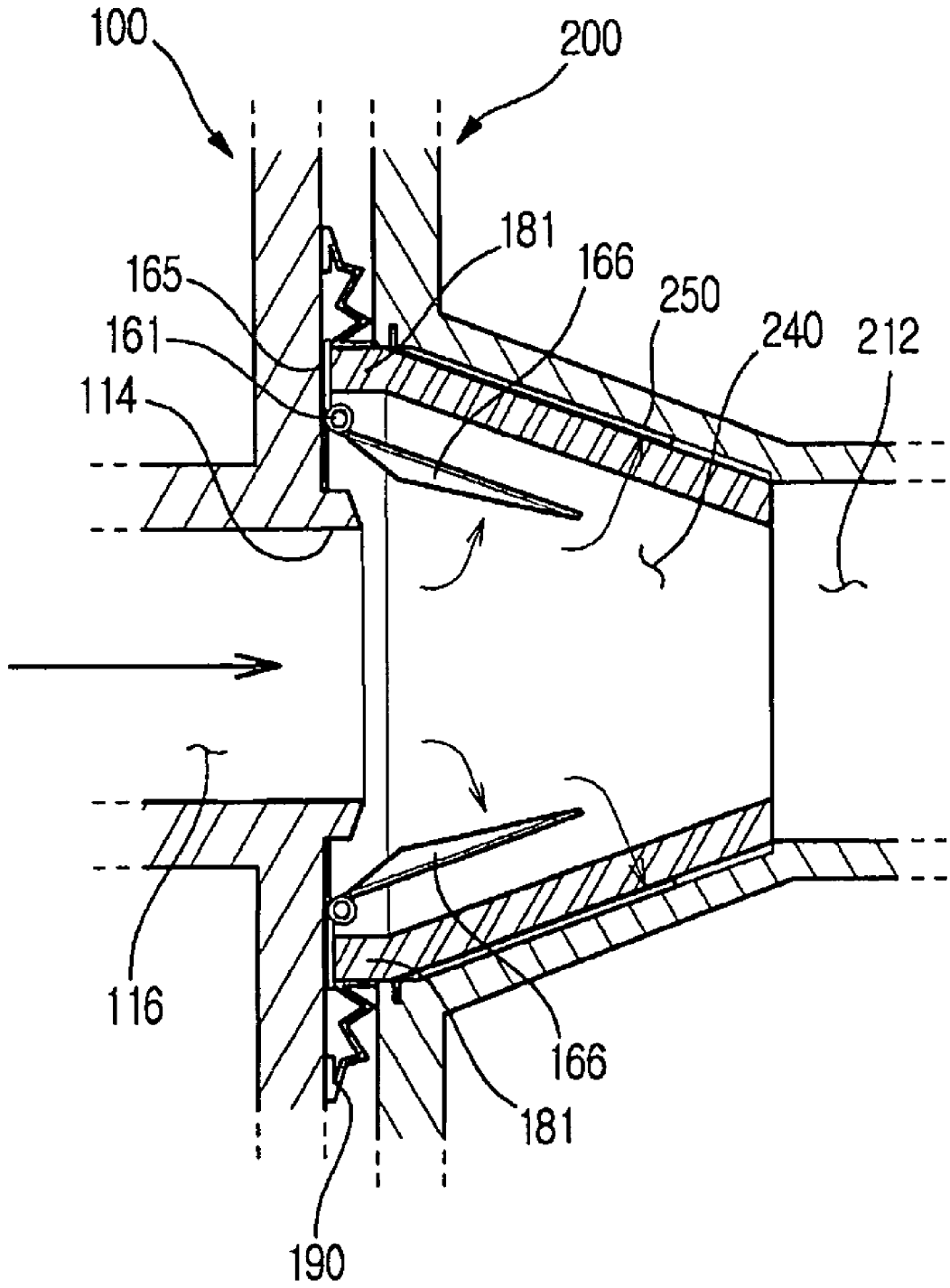
FIG. 11 is a sectional view illustrating a docked state of a robot cleaner of FIG. 10.

FIG. 10 is a sectional view illustrating a protrusion and a guide path provided in a robot cleaner system according to a third embodiment of the present invention. FIG. 11 is a sectional view illustrating a docked state of a robot cleaner of FIG. 10. In the following description of the present embodiment, the same constituent elements as those of FIG. 5 are designated as the same reference numerals. The present embodiment has a difference in the installation structure of the protrusion as compared to the embodiment of FIG. 5. Hereinafter, only characteristic subjects of the present embodiment will be explained. As shown in FIGS. 10 and 11, a protrusion 180 of the robot cleaner 100 according to the present embodiment may be separated from the robot body 10, to move independently of the robot body 110. The protrusion 180 has one end 181 connected to the robot body 110 by use of an elastic joint member 190. The elastic joint member 190 consists of repeatedly formed pleats like a bellows. The use of the protrusion 180 having the above-described configuration is advantageous to alleviate transmission of shock to the robot cleaner 100 and the docking station 200 when they are docked with each other. Also, when the protrusion 180 is inserted into the guide path 240 to guide the docking operation of the robot cleaner 100, the protrusion 180 is movable within a predetermined range and therefore, can ensure a more smooth docking operation of the robot cleaner 100.

In the present embodiment, each pivoting shaft 161 of the first opening/closing device 160 is mounted to the robot body 110, and each lever 165 extends from one end of an associated opening/closing member 166 to the end 181 of the protrusion 180. Accordingly, as the protrusion 180 is introduced into the guide path 240, the end 181 of the protrusion 180 acts to push the lever 165, thus causing the opening/closing member 166 of the first opening/closing device 160 to open the dust discharge hole 114 of the robot cleaner 100.

Figure 12:
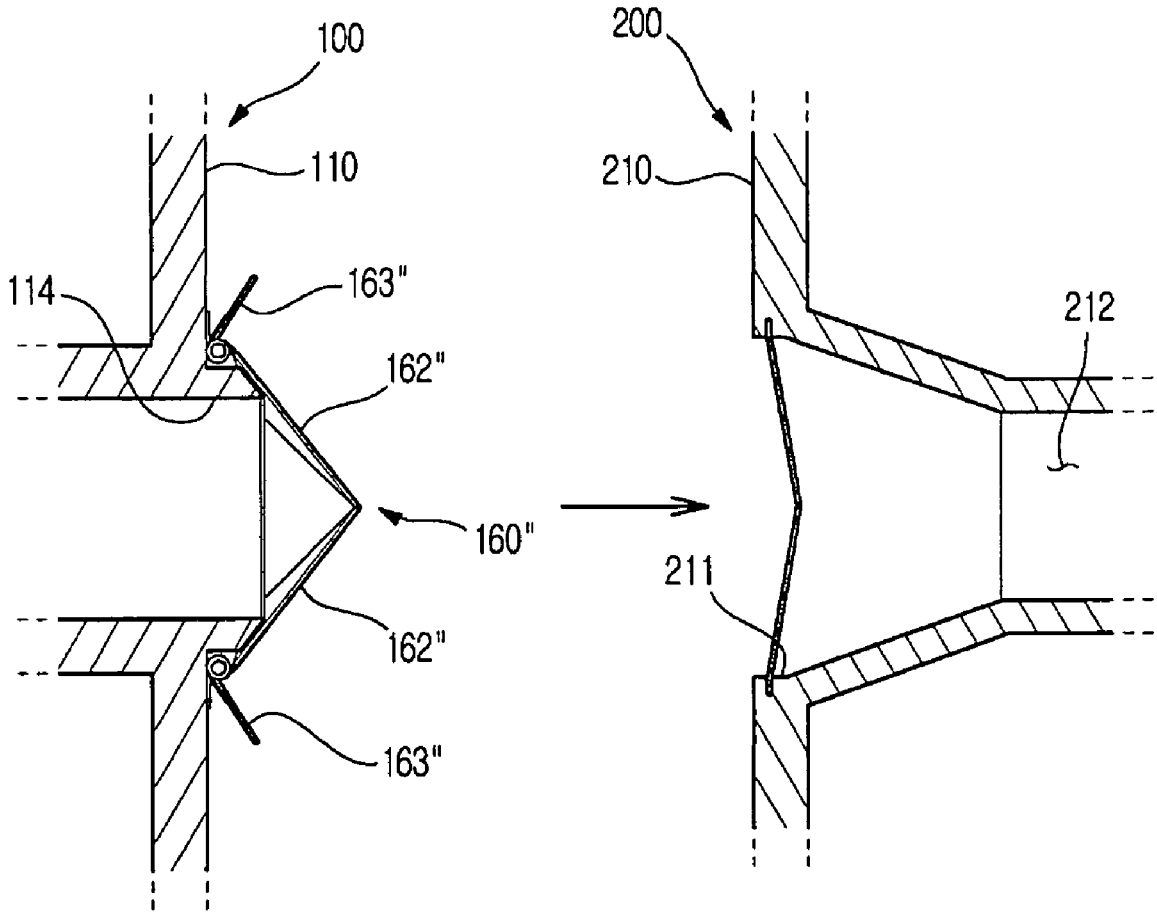
FIG. 12 is a sectional view illustrating a first opening/closing device and a guide path provided in a robot cleaner system according to a fourth embodiment of the present invention.
Figure 13:
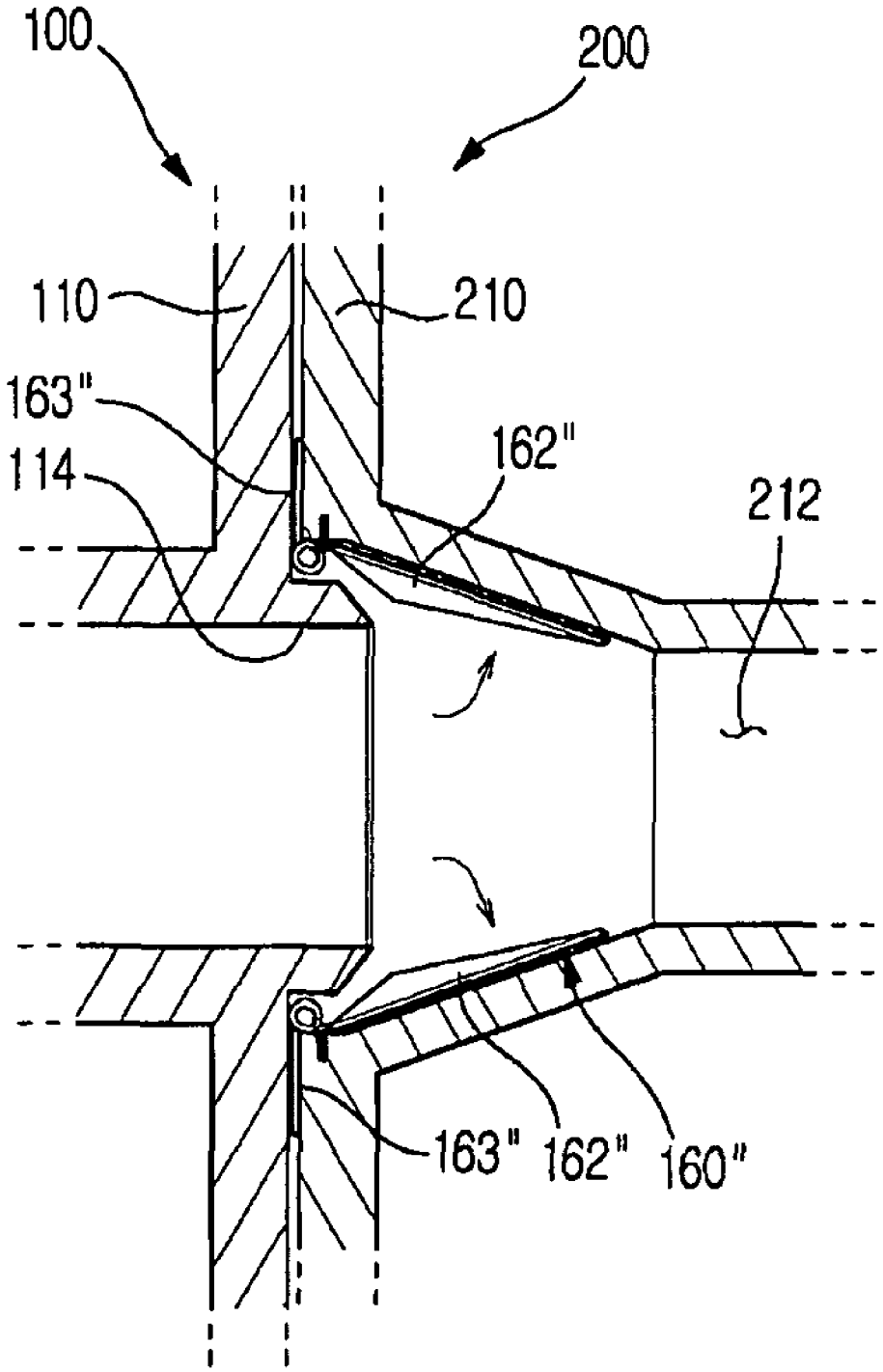
FIG. 13 is a sectional view illustrating a docked state of a robot cleaner of FIG. 12.

FIG. 12 is a sectional view illustrating a first opening/closing device and a guide path provided in a robot cleaner system consistent with a fourth embodiment of the present invention. FIG. 13 is a sectional view illustrating a docked state of a robot cleaner of FIG. 12. In the present embodiment, the robot cleaner has no protrusion and opening/closing members of a first opening/closing device are configured to perform the role of the protrusion.

As shown in FIGS. 12 and 13, a first opening/closing device 160" of the robot cleaner 100 according to an embodiment comprises opening/closing members 162" installed to protrude out of the robot body 110, so as to perform the function of the above described protrusion 150*a* (See FIG. 5). The opening/closing members 162" close the dust discharge hole 114 while the robot cleaner 100 performs the automatic cleaning operation, and are inserted into the dust suction hole 211 when the robot cleaner 100 is docked with the docking station 200. As soon as the docking operation is completed, levers 163" of the first opening/closing device 160" are pushed by the station body 210, thus causing the opening/closing members 162" to pivotally rotate to open the dust discharge hole 114. In this case, the opening/closing members 162" are pivotally rotated toward an inner surface of the dust suction path 212. Since the opening/closing members 162" are elastic members, the opening/closing members 162" can come into close contact with the inner surface of the dust suction path 212 to the maximum extent, thus acting to significantly prevent loss of suction force or leakage of dust.

Figure 14:
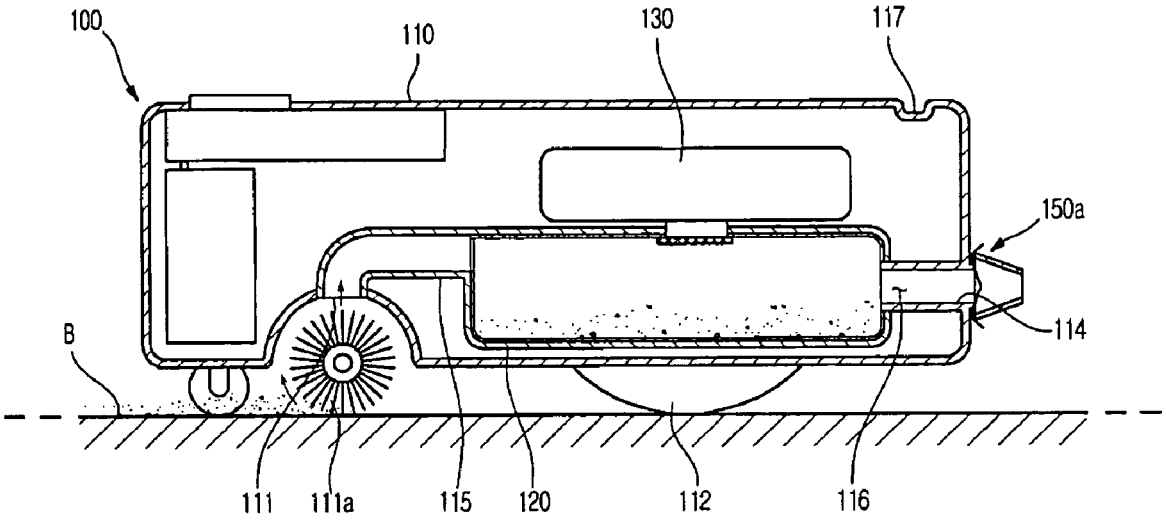
FIGS. 14 and 15 are side sectional views, respectively, illustrating a robot cleaner and a docking station of a robot cleaner system according to a fifth embodiment of the present invention.
Figure 15:
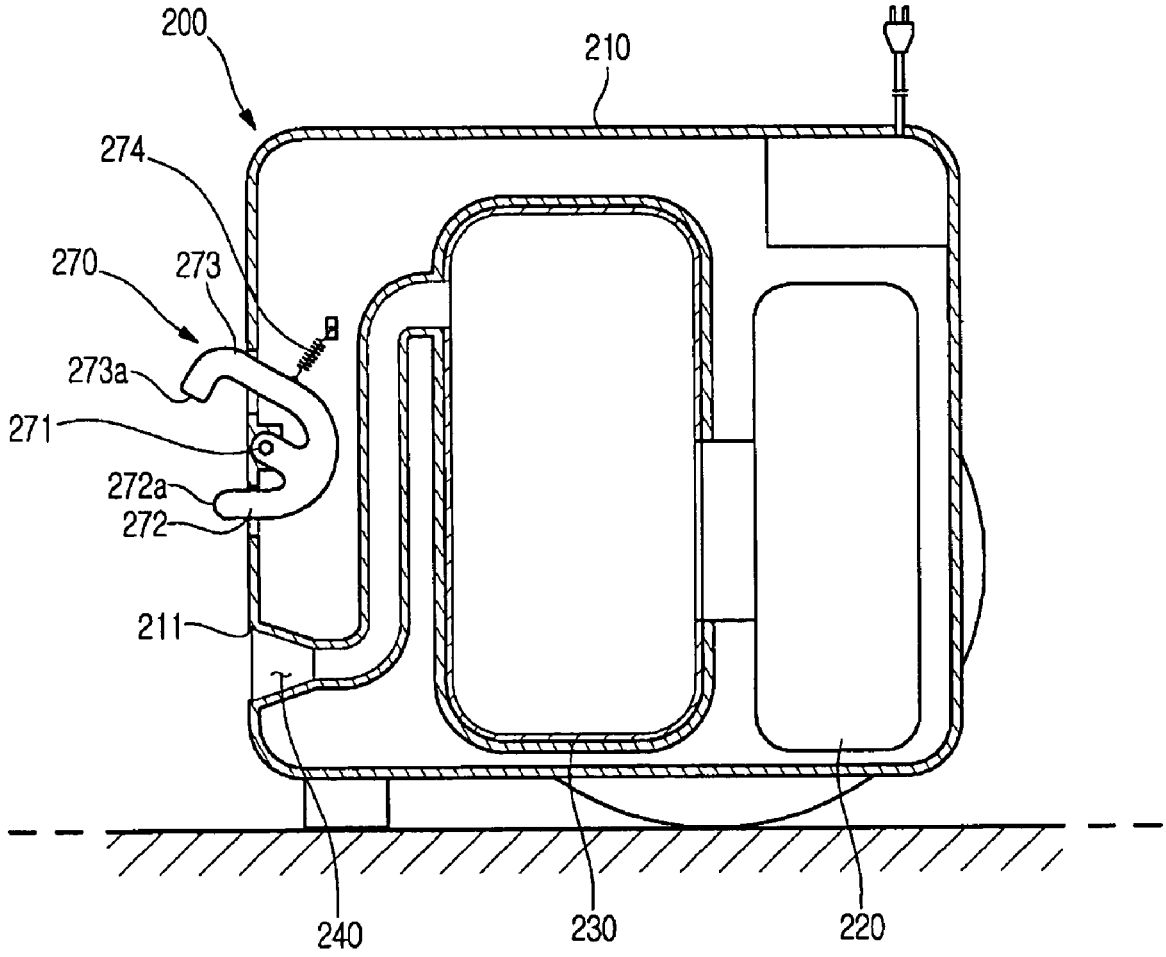
Figure 16A:
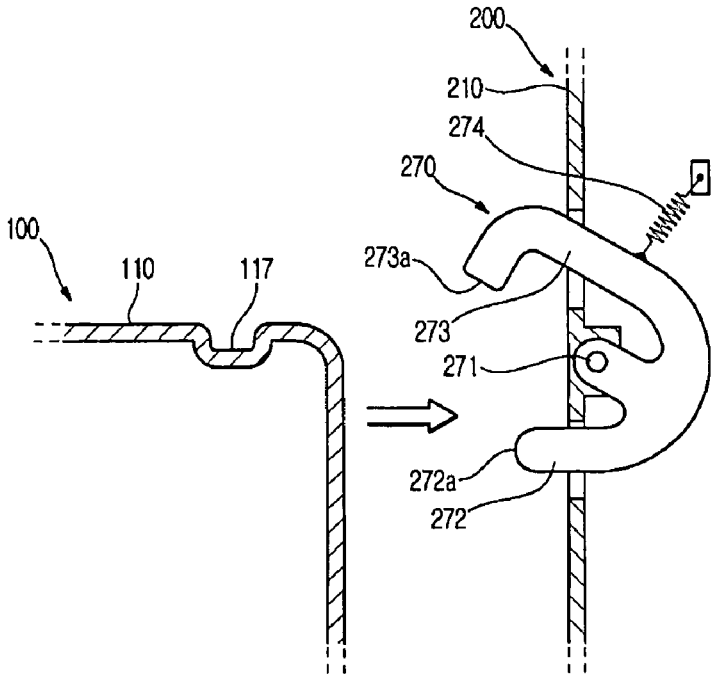
FIGS. 16A to 16C are sectional views illustrating operational parts of the robot cleaner system according to the fifth embodiment of the present invention.
Figure 16B:
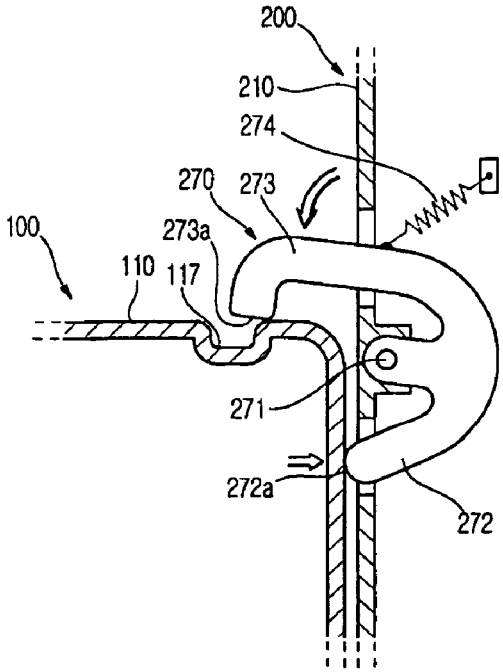
Figure 16C:
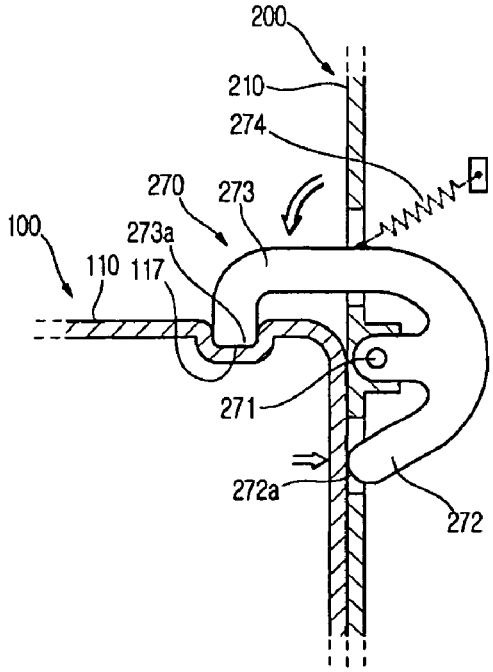

FIGS. 14 and 15 are side sectional views, respectively, illustrating a robot cleaner and a docking station of a robot cleaner system according to a fifth embodiment of the present invention. FIGS. 16A to 16C are sectional views illustrating operational parts of the robot cleaner system according to the fifth embodiment of the present invention. The present embodiment has a difference in the coupling device as compared to the above-described embodiments, and only characteristic subjects of the present embodiment will now be explained.

As shown in FIGS. 14 and 15, the coupling device according an embodiment comprises a coupling lever 270 rotatably installed to the docking station 200 via a pivoting shaft 271. The coupling lever 270 comprises a first coupling arm 272 and a second coupling arm 273, which extend in opposite directions from each other by interposing the pivoting shaft 271. Both ends 272*a* and 273*a* of the coupling lever 270 protrude out of the station body 210. When the robot cleaner 100 is docked with the docking station 200, one end 272*a* of the coupling lever 270 comes into contact with the robot body 110 to allow the coupling lever 270 to rotate about the pivoting shaft 271, and the other end 273*a* of the coupling lever 270 is coupled with the robot body 110 as the coupling lever 270 is rotated. With the use of the coupling lever 270 having the above-described configuration, the robot cleaner 100 and the docking station 200 can be coupled with each other only by use of movement of the robot cleaner 100. Therefore, there is an advantage in that no additional energy for the operation of the lever is required.

Although the other end 273*a* of the coupling lever 270 is coupled with the robot cleaner 100 using a variety of coupling structures, in the present embodiment, a coupling groove 117 is formed at a surface of the robot body 110 for the insertion of the coupling lever 270.

The coupling device of an embodiment further comprises an elastic member 274 to elastically bias the coupling lever 270 in a direction of undocking the robot cleaner 100 from the docking station 200. The elastic member 274 returns the coupling lever 270 to its original position when the robot cleaner 100 is undocked from the docking station 200. In this embodiment, the elastic member 274 is a tensile coil spring having one end secured to the second coupling arm 273 of the coupling lever 270.

Now, characteristic operation of this embodiment will be explained with reference to FIGS. 14-16.

When the amount of dust and debris accumulated in the first dust collector 120 exceeds a predetermined level, the robot cleaner 100 stops the automatic cleaning operation and moves to the docking station 200 for the removal of the dust and debris therein (See FIG. 16A). As the robot cleaner 100 moves close to the docking station 200, the robot body 110 pushes the end 272*a* of the coupling lever 270, thus causing the coupling lever 270 to pivotally rotate about the pivoting shaft 271 (See FIG. 16B). Simultaneously, the protrusion 150*a* of the robot cleaner 100 is inserted into the guide path 240 through the dust suction hole 211 of the docking station 200. If the movement of the robot cleaner 100 is continued further, the other end 273*a* of the coupling lever 270 is further rotated to thereby be inserted into the coupling groove 117 of the robot cleaner 100, thus completing the docking operation. In this case, although the elastic member 274 acts to elastically push the robot cleaner 100, the weight of both the robot cleaner 100 and docking station 200 is far larger than the elastic push force of the elastic member 274. Accordingly, the elastic member 274 has no bad effect on the docking of the robot cleaner 100 (See FIG. 16C).

Figure 17:
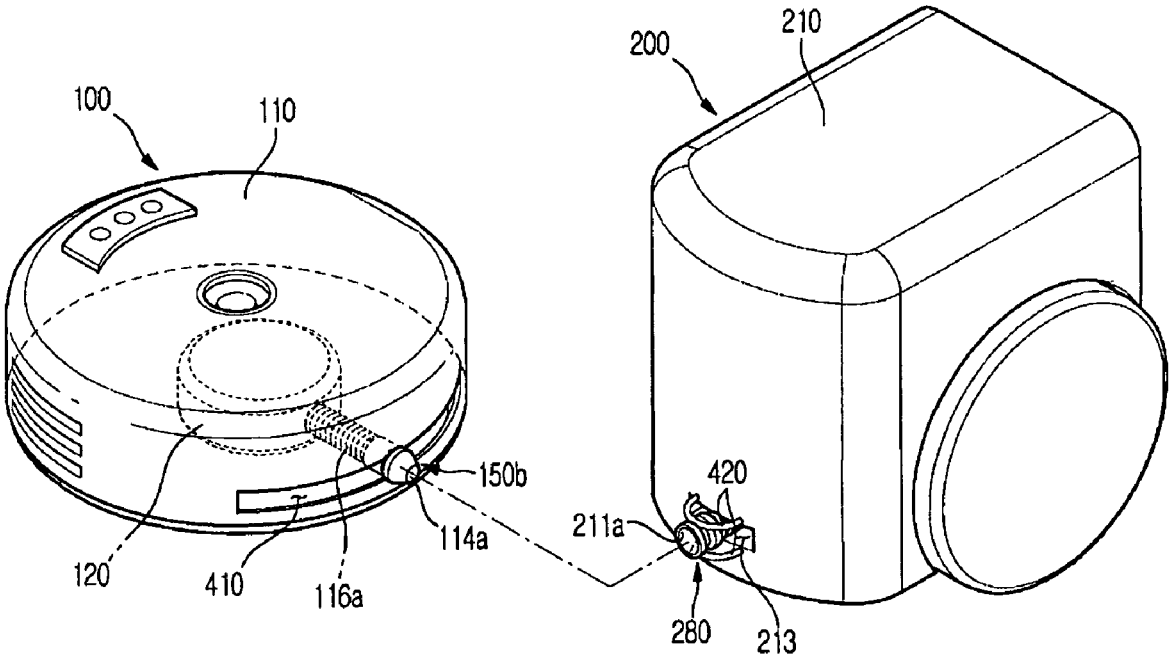
FIG. 17 is a perspective view schematically illustrating the configuration of a robot cleaner system according a sixth embodiment of the present invention.
Figure 18:
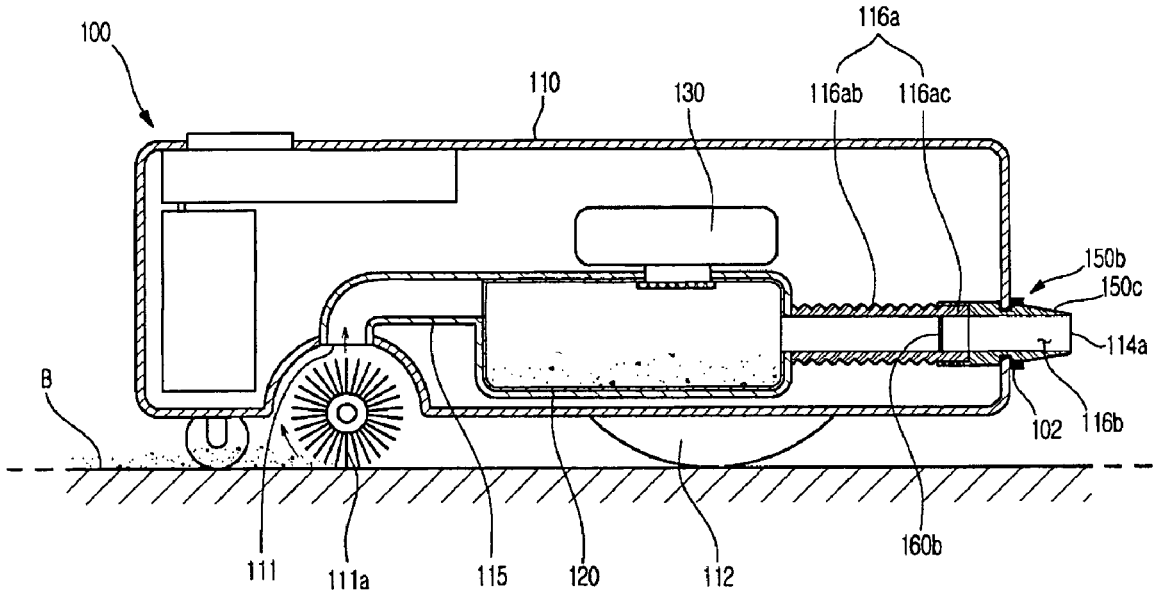
FIGS. 18 and 19 are side sectional views, respectively, illustrating the configuration of a robot cleaner and a docking station of the robot cleaner system of FIG. 17.
Figure 19:
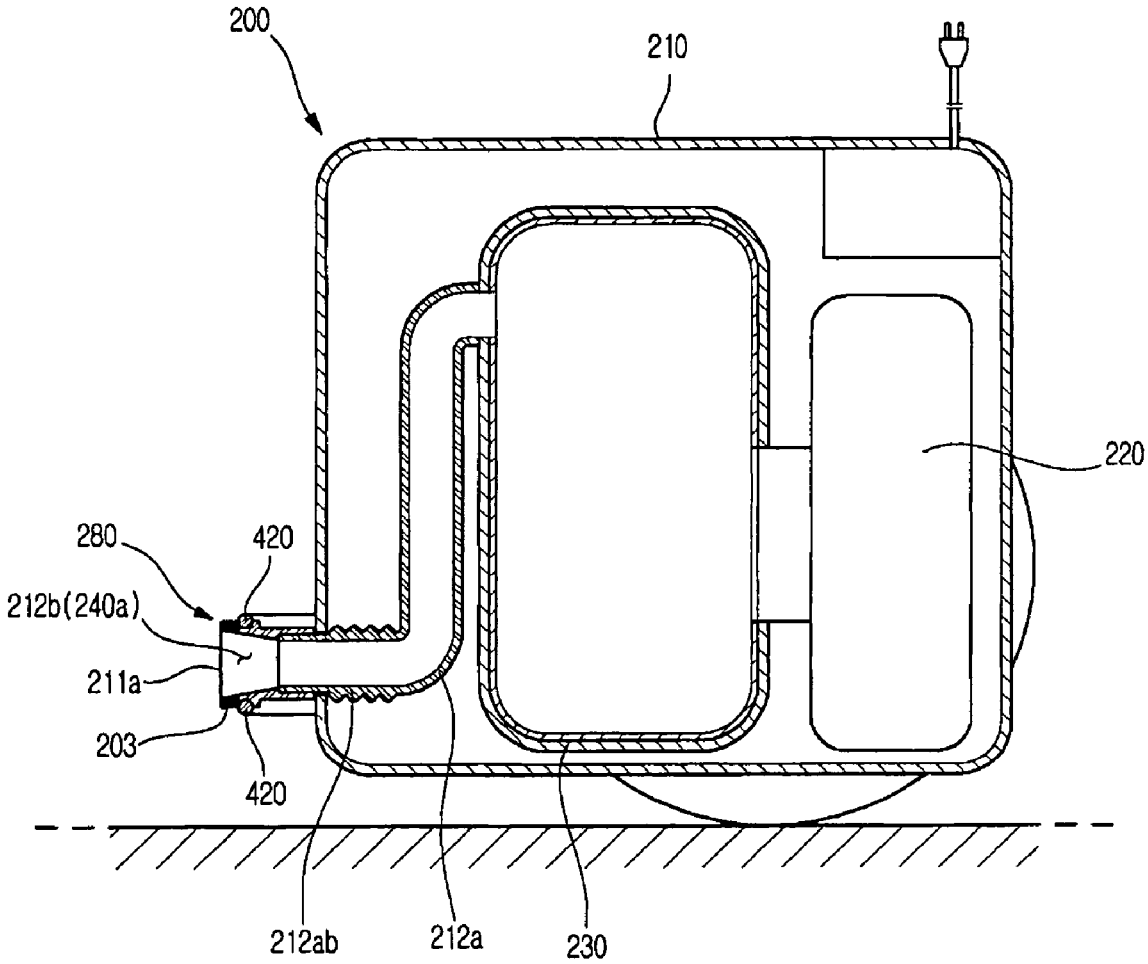

FIG. 17 is a perspective view schematically illustrating the configuration of a robot cleaner system according to a sixth embodiment of the present invention. FIGS. 18 and 19 are side sectional views, respectively, illustrating the configuration of a robot cleaner and a docking station of the robot cleaner system of FIG. 17. This embodiment illustrates a configuration of the robot cleaner having a movable first docking portion formed with a dust discharge hole and the docking station having a movable second docking portion formed with a dust suction hole.

As shown in FIGS. 17-19, in the present embodiment, the docking station 200 comprises a second docking portion 280 to receive a first docking portion 150*b* of the robot cleaner 100. The first docking portion 150*b* of the robot cleaner 100 and the second docking portion 280 of the docking station 200 are movably mounted to the robot body 110 and the station body 210, respectively. When the robot cleaner 100 is docked with the docking station 200, the first and second docking portions 150*b* and 280 are movable, to facilitate the docking operation.

The first docking portion 150*b* comprises one end formed with a dust discharge hole 114*a* and the other end connected to a dust discharge pipe 116*a* that connects the first docking portion 150*b* to the first dust collector 120. The first docking portion 150*b* is internally defined with a connecting path 116*b* to connect the dust discharge hole 114*a* to the dust discharge pipe 116*a*. A magnetically attractable member 102 is provided around an outer periphery of the first docking portion 150*b*.

The second docking portion 280 comprises one end formed with a dust suction hole 211*a* to suck dust and debris discharged from the robot cleaner 100, and the other end connected to a dust suction pipe 212*a* that connects the second docking portion 280 to the second dust collector 220. The second docking portion 280 is internally defined with a connecting path 212*b* to connect the dust suction hole 211*a* to the dust suction pipe 212*a*. An electromagnet 203 is installed to the second docking portion around an outer periphery of the dust suction hole 211*a*, to interact with the magnetically attractable member 102 of the first docking portion 150*b*, thereby achieving a magnetic attraction between the first docking portion 150*b* and the second docking portion 280.

The robot cleaner system according to this embodiment comprises a guiding structure 400 to guide movement of the first docking portion 150*b* or second docking portion 280. In FIGS. 17-19, the guide structure 400 comprises a guide hole 410 to guide movement of the first docking portion 150*b* and guide rails 420 to guide movement of the second docking portion 280.

The guide hole 410 is formed along a side surface of the robot body 110 in a circumferential direction of the robot body 110. The first docking portion 150*b* is fitted in the guide hole 410 so that the first docking portion 150*b* is movably supported, at upper end lower positions thereof, by the guide hole 410. In this case, one end of the first docking portion 150*b* formed with the dust discharge hole 114*a* is located at the outside of the robot body 110, and the other end of the first docking portion 150*b* connected to the dust discharge pipe 116*a* is located in the robot body 110.

The guide rails 420 are installed to protrude outward from a side surface of the station body 210. Two guide rails 420 to support upper and lower positions of the second docking portion 280. The second docking portion 280 are movably coupled between the two guide rails 420. In a state wherein the second docking portion 280 is fitted between the guide rails 420, a part of the dust suction pipe 212*a* connected with the other end of the second docking portion 280 extends out of the station body 210. For this, the station body 210 is perforated with a through-bore 213 so that the dust suction pipe 212*a* penetrates through the bore 213 to extend outward.

The dust discharge pipe 116*a* of the robot cleaner 100 and the dust suction pipe 212*a* of the docking station 200 comprise deformable pipe portions 116*ab* and 212*ab*, respectively. The deformable pipe portions 116*ab* and 212*ab* are made of flexible materials, such as rubber, so that their shape is deformable on the basis of movement of the first docking portion 150*a* or second docking portion 280. In particular, the dust discharge pipe 116*a* comprises a linear pipe portion 116*ac* provided between the deformable pipe portion 116*ab* and the first docking portion 150*b*. The linear pipe portion 116*ac* facilitates the installation of an opening/closing device 160*b* which is used to open and close the dust discharge pipe 116*a*.

The first docking portion 150*b* preferably has a protrusion 150*c*, which is configured to protrude out of the first docking portion 150*b*, so as to be inserted into the dust suction hole 211*a* when the robot cleaner 100 is docked with the docking station 200. The second docking portion 280 comprises a guide path 240*a* having a shape corresponding to that of an outer surface of the protrusion 150*c*. The configuration of the protrusion and guide path were previously described in detail in relation with the embodiment of FIG. 1 and thus, repeated description thereof is omitted.

Now, characteristic operation of this embodiment will be explained with reference to FIGS. 17-20.

When the amount of dust and debris accumulated in the first dust collector 120 exceeds a predetermined level, the robot cleaner 100 stops the automatic cleaning operation and moves to the docking station 200 for the removal of the dust and debris therein (See FIG. 20A). When the robot cleaner 100 moves close to the docking station 200 by a predetermined distance, an electric current is applied to the electromagnet 203 to allow the first docking portion 150*b* and the second docking portion 280 to be moved close to each other by a magnetic attraction between the electromagnet 203 and the magnetically attractable member 102. Thereby, the first docking portion 150*b* and the second docking portion 280 are aligned in position so that the dust discharge hole 116*a* and the dust suction hole 211*a* face each other (See. FIG. 20B). In this case, the movement of the first docking portion 150*b* is guided by the guide hole 410, and the movement of the second docking portion 280 is guided by the guide rails 420. By allowing the first and second docking portions 150*b* and 280 to be moved to each other by the magnetic attraction therebetween, it is possible to achieve a smooth and accurate docking operation even when the robot cleaner 100 is returned to the docking station 200 toward a position of the station 200 slightly deviated from an accurate docking position.

As the robot cleaner 100 is further moved in a state wherein the first docking portion 150*b* and the second docking portion 280 are aligned in position, the protrusion 150*c* is inserted into the dust suction hole 211*a* and the magnetically attractable member 102 is attached to the electromagnet 203. Then, the second blower 220 of the docking station 200 operates to allow the dust and debris stored in the first dust collector 120 of the robot cleaner 100 to be sucked into the second dust collector 230 through the first docking portion 150*b*, second docking portion 280, and dust suction pipe 212*a*.

When the dust and debris in the first dust collector 120 are completely removed, the operation of the second blower 220 is stopped and no electric current is applied to the electromagnet 102. Then, the robot cleaner 100 is undocked from the docking station 200, to again perform the automatic cleaning operation.

Although the above-description explains the case where both the first and second docking portions are movable, it will be appreciated that any one of the first and second docking portions is movable. Also, Alternatively from the above-described embodiment, the electromagnet may be installed to the robot cleaner, and the magnetically attractable member may be installed to the docking station. Similarly, the guide rails may be provided at the robot cleaner, and the guide hole may be formed in the docking station.

Figure 21:
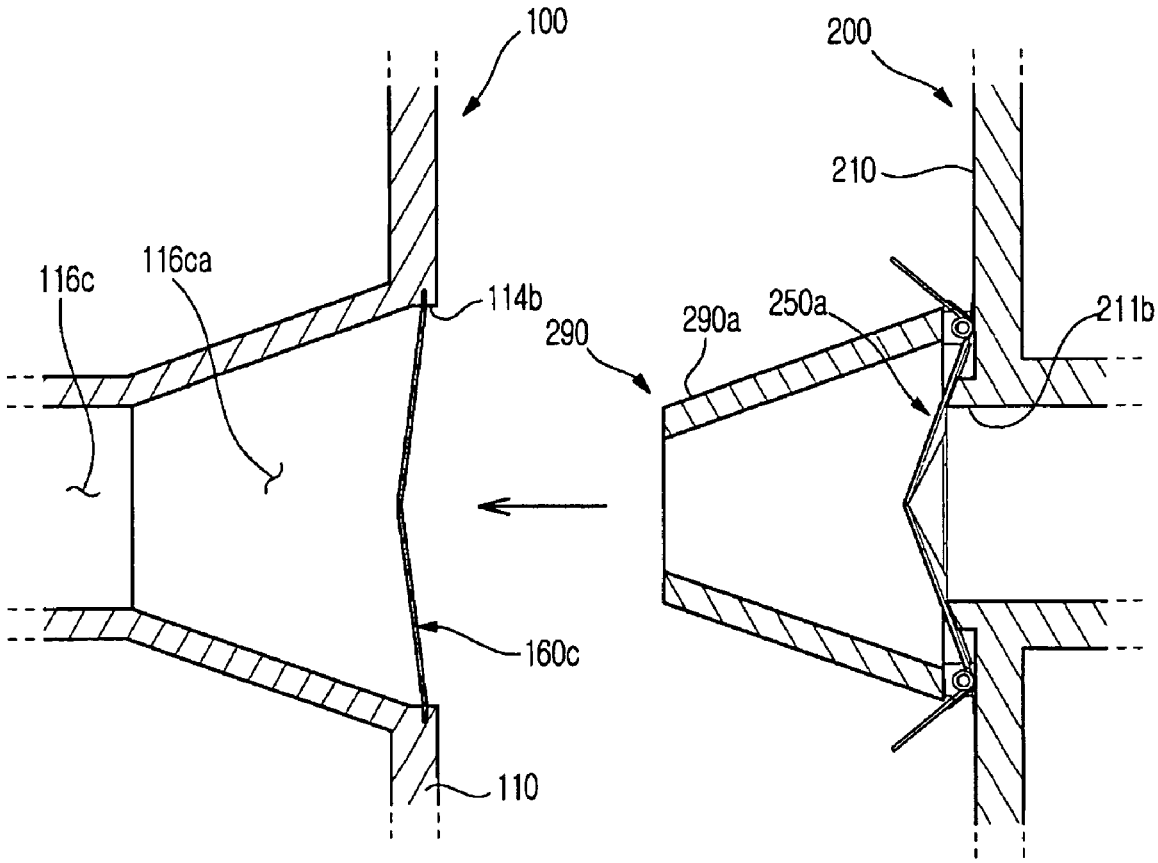
FIG. 21 is a sectional view illustrating a guide path of a robot cleaner and a docking portion of a docking station provided in a robot cleaner system according to a seventh embodiment of the present invention.

FIG. 21 is a sectional view illustrating a guide path of a robot cleaner and a docking portion of a docking station provided in a robot cleaner system according to a seventh embodiment of the present invention. In this embodiment, a docking station comprises a docking portion, and a robot cleaner having a guide path.

As shown in FIG. 21, the docking station 200 comprises a docking portion 290 to be inserted into a dust discharge hole 114*b* of the robot cleaner 100 when the robot cleaner 100 is docked with the docking station 200. Similar to the embodiment of FIG. 5, the docking portion 290 of the docking station 200 comprises a protrusion 290*a*, which is configured to protrude out of the station body 210 to be inserted into the dust discharge hole 114*b* when the robot cleaner 100 is docked with the docking station 200. The protrusion 290*a* communicates a dust suction hole 211*b* of the docking station 200 with a dust discharge path 116*c* of the robot cleaner 100. Also, the dust discharge path 116*c* of the robot cleaner 100 comprises a guide path 116*ca* having a shape corresponding to that of an outer surface of the protrusion 290*a*. The robot cleaner 100 and the docking station 200 are provided, respectively, with opening/closing devices 160*c* and 250*a*, to open and close the dust discharge hole 114*b* or dust suction hole 211*b*. In this embodiment, the shape of the protrusion 290*a* and guide path 116*ca* and the configuration and operation of the opening/closing devices 160*c* and 250*a* can be sufficiently expected from the embodiment of FIG. 5 and thus, repeated description thereof is omitted.

Figure 22:
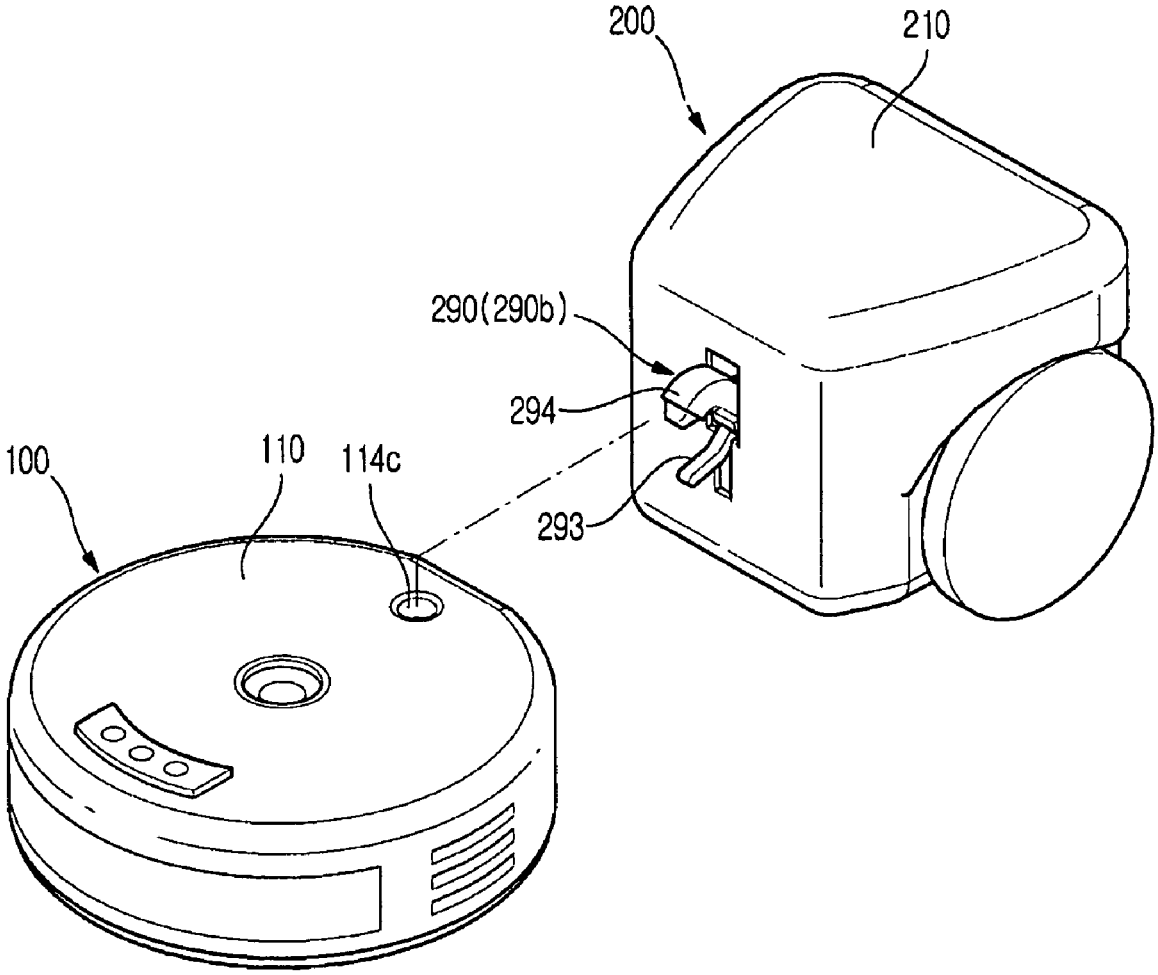
FIG. 22 is a perspective view illustrating an outer appearance of the robot cleaner system according to an eighth embodiment of the present invention.
Figure 23:
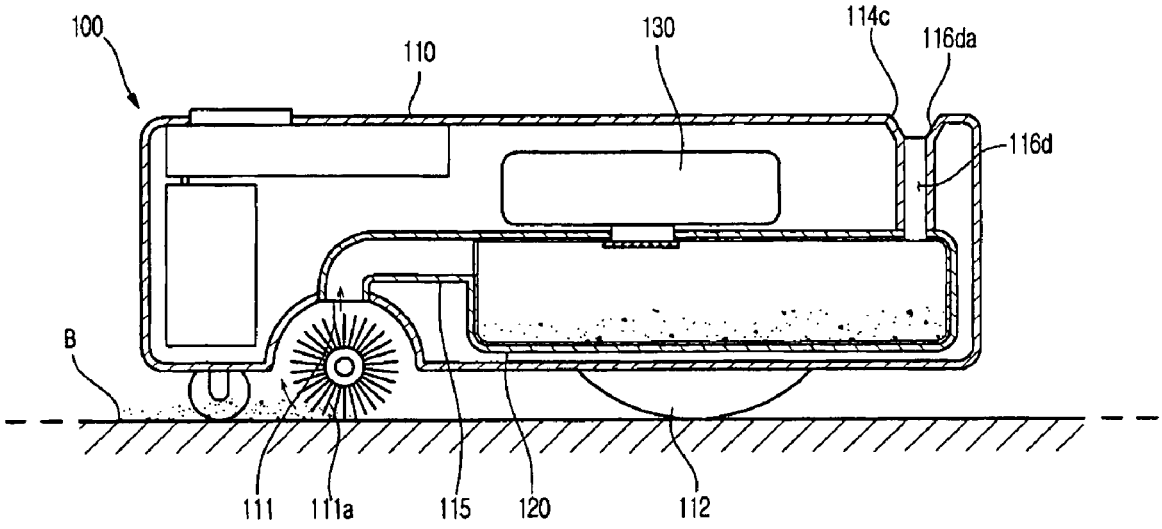
FIGS. 23 and 24 are side sectional views showing the configuration of a robot cleaner and a docking station of FIG. 22.
Figure 24:
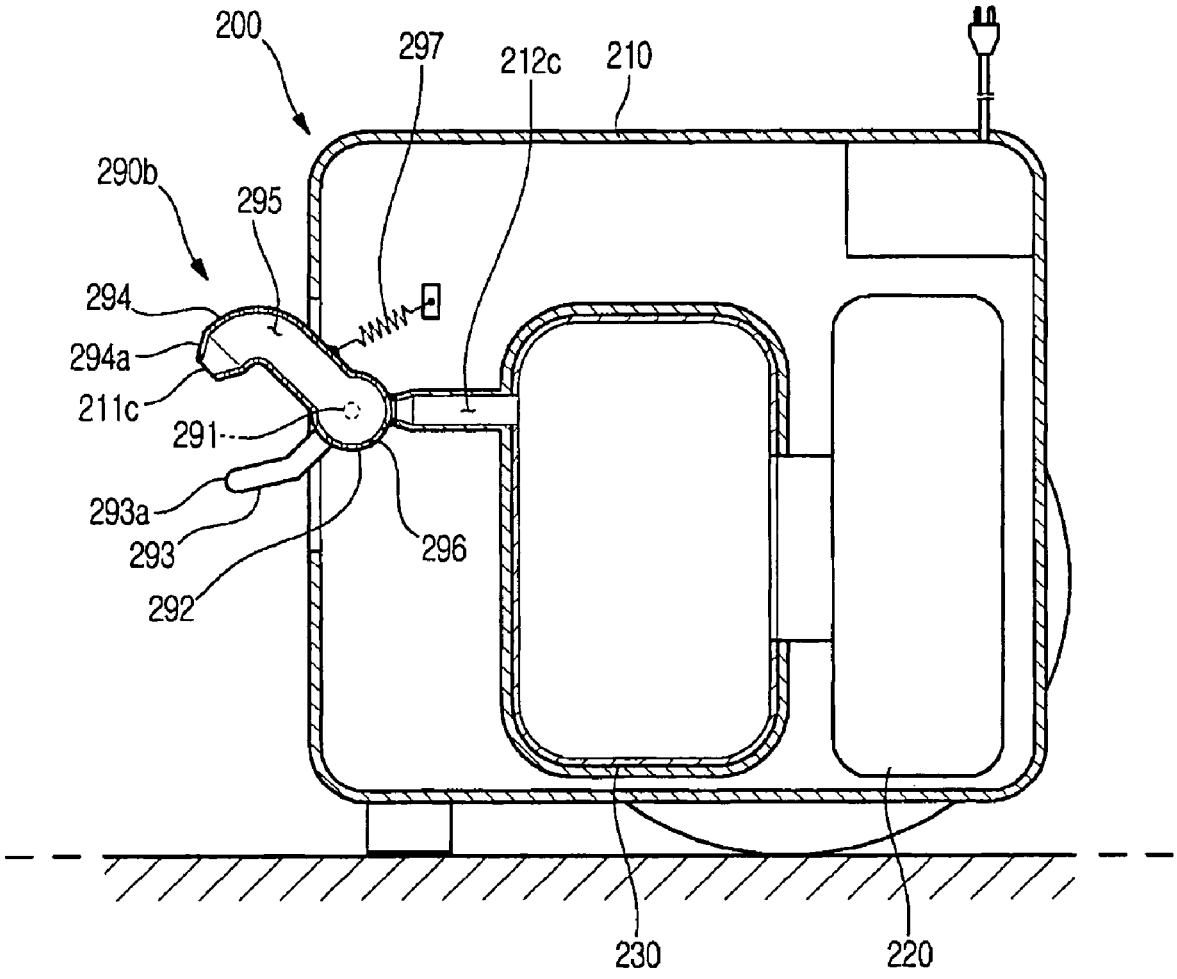
Figure 25:
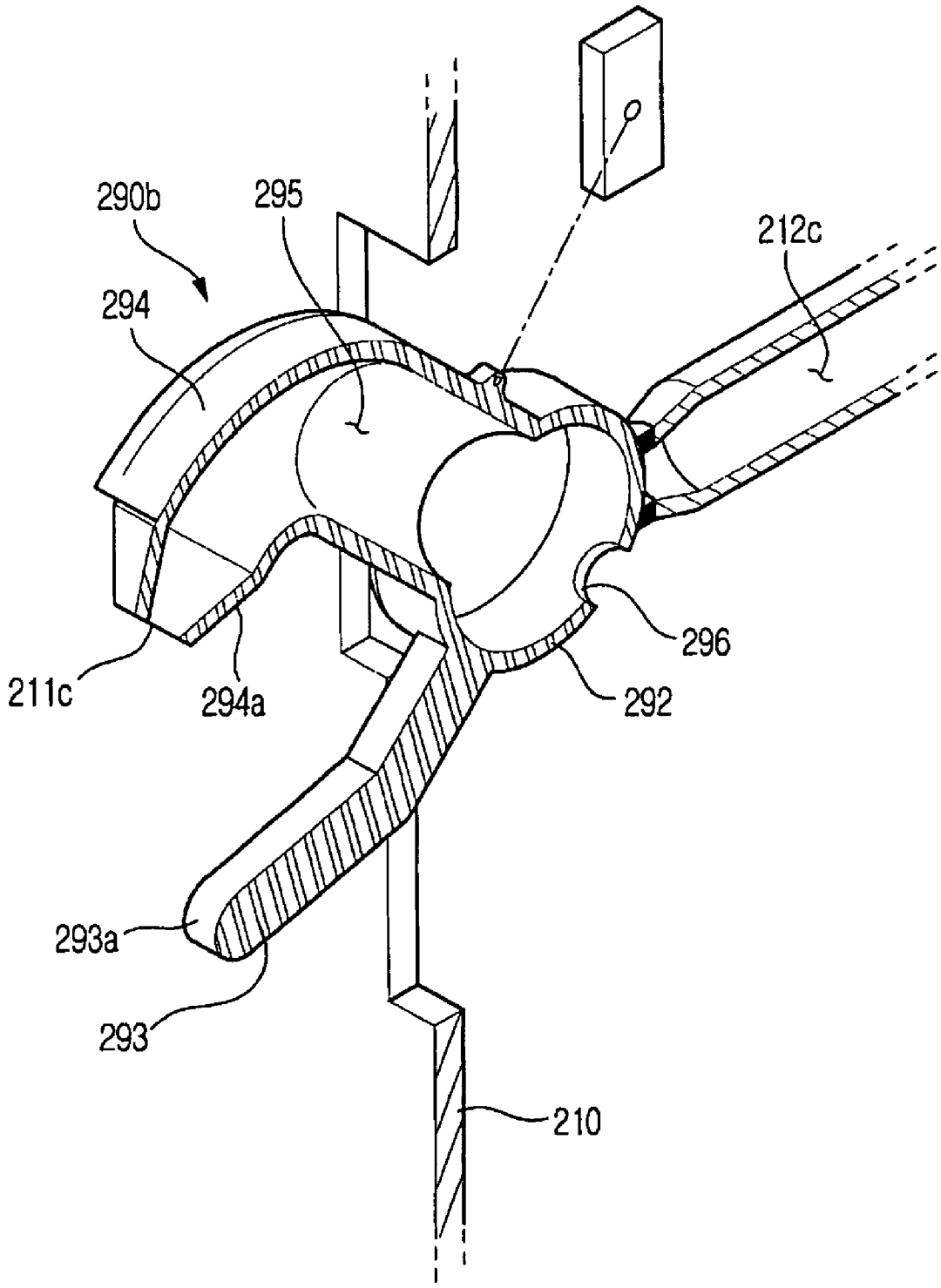
FIG. 25 is a perspective view illustrating a cut-away section of a docking lever of FIG. 22; and, FIGS. 26A to 26C are sectional views illustrating the operation of the robot cleaner system of FIG. 22.

FIG. 22 is a perspective view illustrating the outer appearance of the robot cleaner system according to an eighth embodiment of the present invention. FIGS. 23 and 24 are side sectional views illustrating the configuration of a robot cleaner and a docking station of FIG. 22. FIG. 25 is a perspective view illustrating a cut-away section of a docking lever of FIG. 22.

As shown in FIGS. 22-25, the docking portion 290 of the docking station 200 comprises a docking lever 290*b* having one end to be inserted into a dust discharge hole 114*c* when the robot cleaner 100 is docked with the docking station 200. The docking lever 290*b* is internally defined with a path for the discharge of dust and debris in the robot cleaner 100 and also, serves to stably keep a docked state between the robot cleaner 100 and the docking station 200. The docking lever 290*b* is rotatably installed to the docking station 200 so that one end thereof is pivotally rotated to thereby be inserted into the dust discharge hole 114*c* when the robot cleaner 100 is docked with the docking station 200.

The docking lever 290*b* comprises a lever body 292 that is provided at opposite sides thereof with pivoting shafts 291 and defines a predetermined space therein, and first and second docking arms 293 and 294 extended from the lever body 292 to protrude out of the station body 210, the first and second docking arms 293 and 294 having a predetermined angle therebetween. When the robot cleaner 100 is moved close to the docking station 200, the first docking arm 293 comes into contact with the robot body 110 to allow the docking lever 290*b* to be pivotally rotated, and the second docking arm 294 is inserted into the dust discharge hole 114*c* of the robot cleaner 100 as the docking lever 290*b* is rotated, thereby defining a dust discharge path.

The second docking arm 294 comprises one end 294*a* to be inserted into the dust discharge hole 114*c*, the end 294*a* being formed with a dust suction hole 211*c*. The other end of the second docking arm 294 communicates with the inner space of the lever body 292. A lever path 295 is defined between the dust suction hole 211*c* and the lever body 292, to allow dust discharged from the robot cleaner 100 to be transferred into the docking station 200.

According to an embodiment of the present invention, the end 294*a* of the second docking arm 294 comprises a tapered outer surface so that a cross sectional area of the second docking arm 294 is gradually reduced toward the dust suction hole 211*c*. Also, a dust discharge path 116*d* of the robot cleaner 100 comprises a guide path 116*da* having a shape corresponding to that of the end 294*a* of the second docking arm 294. With this configuration, the second docking arm 294 can be easily inserted into or separated from the dust discharge hole 114*c*. Furthermore, when the robot cleaner 100 is completely docked with the docking station 200 and the second blower 220 is operated, loss of a suction force generated by the second blower 230 through a gap between the second docking arm 294 and the dust discharge path 116*d* can be more completely prevented.

The lever body 292 is rotatably mounted in the station body 210 via the pivoting shafts 291 and located close to the dust suction path 212*c* of the docking station 200. The lever body 292 is formed with a connecting hole 296 to communicate the space of the lever body 292 with the dust suction path 212*c* when the dust suction hole 211*c* is inserted into the dust discharge hole 114*c*.

The docking station 200 comprises an elastic member 297 to elastically bias the docking lever 290*b* in a direction of separating the end 294*a* of the second docking arm 294 from the dust discharge hole 114*c*. The elastic member 297 allows the docking lever 290*b* to be returned to its original state when the robot cleaner 100 is undocked with the docking station 200. In the present embodiment, the elastic member 297 takes the form of a tensile coil spring having one end secured to the second docking arm 294 of the docking lever 290*b*.

Figure 26A:
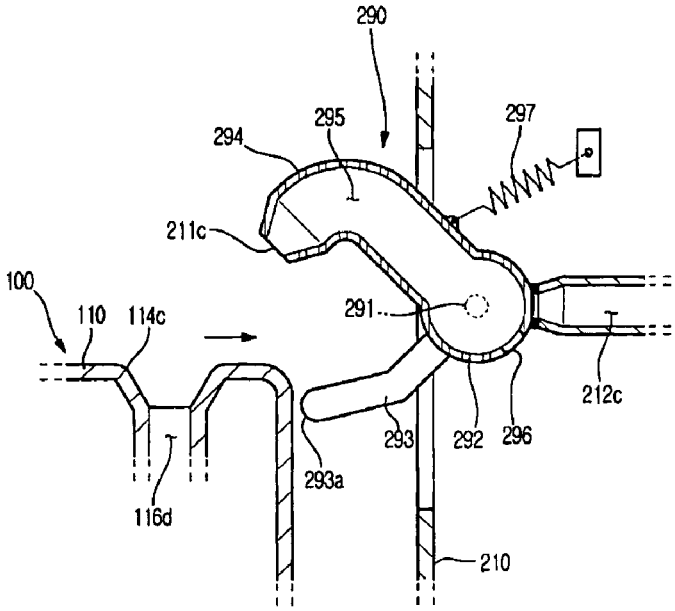
Figure 26B:
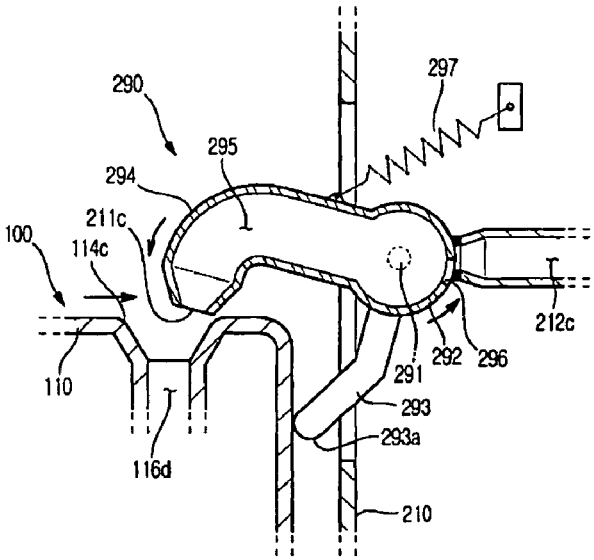
Figure 26C:
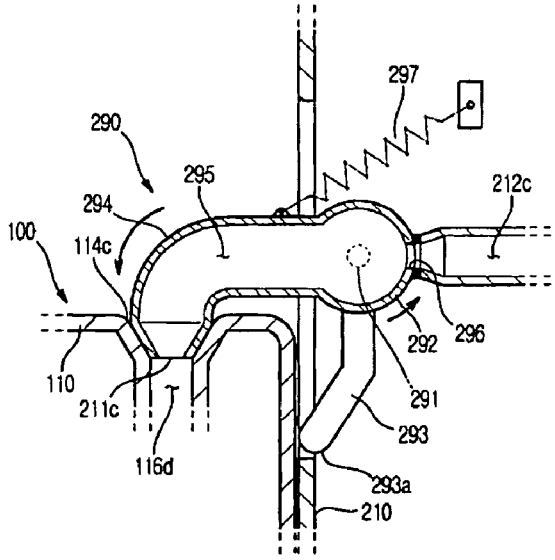

Now, characteristic operation of the present embodiment will be explained with reference to FIGS. 22-25 and FIGS. 26A-26C. FIGS. 26A-26C are sectional views showing the operation of the robot cleaner system shown in FIG. 22.

When the amount of dust and debris accumulated in the first dust collector 120 exceeds a predetermined level, the robot cleaner 100 stops the automatic cleaning operation and moves to the docking station 200 for the removal of the dust and debris therein (See FIG. 26A). As the robot cleaner 100 moves close to the docking station 200, the robot body 110 pushes the end 293*a* of the first docking arm 293, thus causing the docking lever 290*b* to pivotally rotate about the pivoting shafts 291 (See FIG. 26B). When the movement of the robot cleaner 100 is continued further, the dust suction hole 211*c* of the second docking arm 294 is inserted into the dust discharge hole 114*c* of the robot cleaner 100, and the connecting hole 296 of the lever body 292 communicates with the dust suction path 212*c* of the docking station 200 (See FIG. 26C).

After completion of the above described docking operation, the second blower 220 of the docking station 200 is operated, to allow dust and debris stored in the first dust collector 120 of the robot cleaner 100 to be sucked into the second dust collector 230 by passing through the dust discharge path 116*d*, lever path 295, lever body 292, and dust suction path 212*c* in sequence.

As apparent from the above description, the present invention provides a robot cleaner system having the following effects.

Firstly, according to an embodiment of the present invention, a robot cleaner comprises a docking portion to be inserted into a docking station when the robot cleaner is docked with the docking station. The provision of the docking portion has the effect of preventing not only loss of a suction force generated in the docking station, but also leakage of dust in the course of transferring the dust from the robot cleaner into the docking station.

Secondly, the docking portion guides a smooth docking operation of the robot cleaner within an expanded docking range, thereby accomplishing an easy and accurate docking operation of the robot cleaner.

Thirdly, according to an embodiment of the present invention, the docking portion is a protrusion, which is designed to come into contact with a guide path defined in the docking station with an increased contact area. This has the effect of more efficiently preventing the loss of the suction force generated in the docking station and the leakage of dust in the course of transferring the dust into the docking station.

Fourthly, the robot cleaner can be stably kept in a docked state with the docking station by use of an electromagnet, magnetically attractable member, coupling lever, and docking lever.

Although embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A robot cleaner system comprising:

a robot cleaner comprising a robot body and a dust discharge hole to discharge dust stored in the robot body; and a docking station comprising a dust suction hole to suck the dust discharged out of the robot body, a dust suction path to guide the dust sucked through the dust suction hole, and a dust collector to collect the dust sucked through the dust suction hole, wherein the robot cleaner comprises a first docking portion to be inserted into the dust suction hole when the robot cleaner is docked with the docking station, and wherein the first docking portion is a protrusion, which protrudes out of the robot body to be inserted into the dust suction hole upon a docking operation, the protrusion communicates the dust discharge hole with the dust suction path, wherein the robot cleaner comprises an opening/closing device to mechanically open the dust discharge hole based only on mechanical contact with the docking station while the robot cleaner is docked with the docking station, the opening/closing device operating independently of a power state of the robot cleaner system.

2. The robot cleaner system according to claim 1, wherein the protrusion comprises a tapered surface at an outer surface thereof such that a cross sectional area of the protrusion is gradually reduced over at least a part of the protrusion along a protruding direction of the protrusion.

3. The robot cleaner system according to claim 2, wherein the dust suction path comprises a guide path having a shape corresponding to that of the outer surface of the protrusion.

4. The robot cleaner system according to claim 2, wherein the protrusion comprises a truncated circular cone shape.

5. The robot cleaner system according to claim 1, wherein the opening/closing device closes the dust discharge hole while the robot cleaner performs an automatic cleaning operation.

6. The robot cleaner system according to claim 1, further comprising:

a coupling device to strongly keep the robot cleaner and the docking station in their docked state.

7. The robot cleaner system according to claim 6, wherein the coupling device comprises:

an electromagnet installed in one of the robot cleaner and the docking station; and a magnetically attractable member installed in the other one of the robot cleaner and the docking station.

8. The robot cleaner system according to claim 7, wherein the electromagnet is installed to surround the dust suction hole, and the magnetically attractable member is installed to surround the dust discharge hole to correspond to the electromagnet.

9. The robot cleaner system according to claim 1, further comprising:

a sensing device to sense the completion of a docking operation of the robot cleaner, and wherein the sensing device comprises a robot sensor and a station sensor installed, respectively, to the robot cleaner and the docking station, so as to come into contact with each other when the docking operation of the robot cleaner is completed.

10. A robot cleaner system comprising:

a robot cleaner comprising a robot body and a dust discharge hole to discharge dust stored in the robot body; and a docking station comprising a dust suction hole to suck the dust discharged out of the robot body, a dust suction path to guide the dust sucked through the dust suction hole, and a dust collector to collect the dust sucked through the dust suction hole, wherein the robot cleaner comprises a first docking portion to be inserted into the dust suction hole when the robot cleaner is docked with the docking station, wherein the robot cleaner comprises an opening/closing device to close the dust discharge hole while the robot cleaner performs an automatic cleaning operation and to open the dust discharge hole while the robot cleaner is docked with the docking station, and wherein the opening/closing device comprises a plurality of opening/closing units installed in a circumferential direction of the dust discharge hole, and wherein each opening/closing unit comprises:

an opening/closing member to pivotally rotate about a pivoting shaft within the protrusion, to open and close the dust discharge hole, a lever extended out of the protrusion from one end of the opening/closing member coupled to the pivoting shaft, and an elastic member to elastically bias the opening/closing member in a direction of closing the dust discharge hole.

11. The robot cleaner system according to claim 10, wherein the opening/closing member is made of an elastically deformable material.

12. The robot cleaner system according to claim 10, wherein the elastic member is a coil-shaped torsion spring comprises a center portion to be fitted around the pivoting shaft, a first end supported by the robot body, and a second end supported by a lower surface of the lever.

13. A robot cleaner system comprising:

a robot cleaner comprising a robot body and a dust discharge hole to discharge dust stored in the robot body; and a docking station comprising a dust suction hole to suck the dust discharged out of the robot body, a dust suction path to guide the dust sucked through the dust suction hole, and a dust collector to collect the dust sucked through the dust suction hole, wherein the robot cleaner comprises a first docking portion to be inserted into the dust suction hole when the robot cleaner is docked with the docking station, wherein the first docking portion is a protrusion, which protrudes out of the robot body to be inserted into the dust suction hole upon a docking operation, the protrusion communicates the dust discharge hole with the dust suction path, and the docking station comprises an opening/closing device to be mechanically pushed and elastically deformed by the protrusion as the protrusion is inserted into the docking station, to open the dust suction hole, the opening/closing device operating independently of a power state of the robot cleaner system.

14. A robot cleaner system comprising:

a robot cleaner comprising a robot body having a dust discharge hole; and a docking station comprising a dust suction hole to suck dust discharged out of the robot body, a dust suction path to guide the dust sucked through the dust suction hole, and a dust collector to collect the dust sucked through the dust suction hole, wherein the robot cleaner comprises a protrusion which protrudes out of the robot body to be inserted into the dust suction hole when the robot cleaner is docked with the docking station, the protrusion communicates the dust discharge hole with the dust suction path, and wherein the protrusion is separately installed from the robot body, and one end of the protrusion is connected with the robot body by a flexible joint member having repeatedly formed pleats.

15. The robot cleaner system according to claim 14, wherein an outer surface of the protrusion comprises a tapered surface so that a cross sectional area of the protrusion is gradually reduced over at least a part of the protrusion along a protruding direction of the protrusion.

16. The robot cleaner system according to claim 14, wherein the robot cleaner comprises an opening/closing device to open and close the dust discharge hole, and the opening/closing device comprises a plurality of opening/closing units installed in a circumferential direction of the dust discharge hole, and wherein each opening/closing unit comprises:

an opening/closing member to pivotally rotate about a pivoting shaft, to open and close the dust discharge hole;

a lever extended from one end of the opening/closing member coupled with the pivoting shaft to one end of the protrusion; and an elastic member to elastically bias the opening/closing member in a direction of closing the dust discharge hole.

17. A robot cleaner system comprising:

a robot cleaner comprises a robot body having a dust discharge hole; and a docking station comprising a dust suction hole to suck dust discharged out of the robot body , a dust suction path to guide the dust sucked through the dust suction hole, and a dust collector to collect the dust sucked through the dust suction hole, wherein the robot cleaner comprises a protrusion which protrudes out of the robot body to be inserted into the dust suction hole when the robot cleaner is docked with the docking station, the protrusion communicates the dust discharge hole with the dust suction path, and wherein the dust suction path comprises a guide path comprising a tapered surface such that the path is gradually narrowed over at least a part thereof in a direction along which the protrusion is introduced upon a docking operation of the robot cleaner, wherein the robot cleaner comprises an opening/closing device to mechanically open the dust discharge hole due to mechanical contact with the docking station while the robot cleaner is docked with the docking station, the opening/closing device operating independently of a power state of the robot cleaner system.

18. The robot cleaner system according to claim 17, wherein the guide path comprises a truncated circular cone shape having a cross sectional area that is gradually reduced away from the dust suction hole.

19. The robot cleaner system according to claim 17, wherein the robot cleaner comprises an opening/closing device to close the dust discharge hole while the robot cleaner performs an automatic cleaning operation.

20. A robot cleaner system comprising:

a robot cleaner comprising a robot body having a dust discharge hole; and a docking station comprising a station body having a dust suction hole to correspond to a position of the dust discharge hole when the robot cleaner is docked with the docking station, wherein the robot cleaner comprises an opening/closing device to open and close the dust discharge hole and the opening/closing device protrudes from the dust discharge hole to be directly inserted into the dust suction hole when the robot cleaner is docked with the docking station, the opening/closing device communicates the dust discharge hole with the dust suction hole, and the opening/closing device comprises a plurality of opening/closing units installed in a circumferential direction of the dust discharge hole, wherein each opening/closing unit comprises:

an opening/closing member to pivotally rotate about a pivoting shaft , to open and close the dust discharge hole;

a lever extended from one end of the opening/closing member coupled with the pivoting shaft toward the outside of the opening/closing member; and an elastic member to elastically bias the opening/closing member in a direction of closing the dust discharge hole, wherein the opening/closing member is inserted into the dust suction hole upon a docking operation of the robot cleaner.

21. A robot cleaner system comprising:

a robot cleaner comprising a dust discharge hole and a dust discharge path to guide dust stored in the robot cleaner toward the dust discharge hole; and a docking station comprising a station body, a dust suction hole to suck the dust discharged through the dust discharge hole into the station body, a dust suction path to guide the sucked dust, and a dust collector to collect the dust sucked through the dust suction hole, wherein the docking station comprises a docking portion to be inserted into the dust discharge hole when the robot cleaner is docked with the docking station, and wherein the docking portion is a docking lever rotatably installed to the docking station, the docking lever comprising a first end to pivotally rotate so as to be inserted into the dust discharge hole upon the docking operation of the robot cleaner.

22. The robot cleaner system according to claim 21, wherein the docking lever comprises:

a first arm to come into contact with the robot cleaner, to rotate the docking lever, and a second arm to be inserted into the dust discharge hole as the docking lever is rotated.

23. The robot cleaner system according to claim 21, wherein the docking lever comprises a connecting hole to communicate the docking lever with the dust suction path when the first end of the docking lever is inserted into the dust discharge hole.

24. The robot cleaner system according to claim 21, further comprising:

an elastic member to elastically bias the docking lever in a direction of separating the first end of the docking lever from the dust discharge hole.

* * * * *

UNITED STATES PATENT AND TRADEMARK OFFICE

CERTIFICATE OF CORRECTION

PATENT NO. : 7,861,366 B2
APPLICATION NO. : 11/653251
DATED : January 4, 2011
INVENTOR(S) : Jung Yoon Hahm et al.

It is certified that error appears in the above-identified patent and that said Letters Patent is hereby corrected as shown below:

Column 21, Line 45 (Approx.), In Claim 17, delete “body ,” and insert --body,--, therefor.

Column 22, Line 25, In Claim 20, delete “shaft ,” and insert --shaft,--, therefor.

Signed and Sealed this
Twenty-sixth Day of April, 2011

David J. Kappos

David J. Kappos
*Director of the United States Patent and Trademark Office*